US012178285B2

(12) United States Patent
Case et al.

(10) Patent No.: US 12,178,285 B2
(45) **Date of Patent: *Dec. 31, 2024**

(54) SOLE STRUCTURE FOR ARTICLE OF FOOTWEAR

(71) Applicant: NIKE, Inc., Beaverton, OR (US)

(72) Inventors: Patrick Case, Beaverton, OR (US); Zachary M. Elder, Portland, OR (US); Nathan A. Jacobsen, Portland, OR (US); Roger Paul Murphy, Beaverton, OR (US); Lee D. Peyton, Tigard, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/335,085

(22) Filed: Jun. 14, 2023

(65) Prior Publication Data

US 2023/0320458 A1 Oct. 12, 2023

Related U.S. Application Data

(63) Continuation of application No. 17/366,452, filed on Jul. 2, 2021, now Pat. No. 11,712,085, which is a (Continued)

(51) Int. Cl.
*A43B 13/20* (2006.01)
*A43B 13/04* (2006.01)

(Continued)

(52) U.S. Cl.
CPC ..... *A43B 13/20* (2013.01); *A43B 13/04* (2013.01); *A43B 13/12* (2013.01); *A43B 13/127* (2013.01);

(Continued)

(58) Field of Classification Search
CPC ..... A43B 13/20; A43B 13/203; A43B 13/206
See application file for complete search history.

(56) References Cited

U.S. PATENT DOCUMENTS 4,183,156 A 1/1980 Rudy
4,936,029 A 6/1990 Rudy (Continued)

FOREIGN PATENT DOCUMENTS

CN 101032353 A 9/2007
CN 105008119 A 10/2015

(Continued)

OTHER PUBLICATIONS

USPTO, Non-Final Office Action for U.S. Appl. No. 15/459,131, mailed Mar. 14, 2018.

(Continued)

*Primary Examiner* — Ted Kavanaugh
(74) *Attorney, Agent, or Firm* — Honigman LLP; Matthew H. Szalach; Jonathan P. O'Brien

(57) ABSTRACT

A sole structure for an article of footwear having an upper includes a heel region, a forefoot region, and a mid-foot region disposed between the heel region and the forefoot region. The sole structure also includes a fluid-filled chamber including a first barrier layer cooperating with a second barrier layer to define a fluid-filled segment extending along a medial side of the sole structure within the heel region, a second fluid-filled segment extending along a lateral side of the sole structure within the heel region, and a web area disposed between and connecting the first fluid-filled segment and the second fluid-filled segment. The first barrier layer is attached to the second barrier layer within the web area.

18 Claims, 7 Drawing Sheets

Related U.S. Application Data continuation of application No. 16/217,279, filed on Dec. 12, 2018, now Pat. No. 11,051,582, which is a continuation of application No. 15/459,131, filed on Mar. 15, 2017, now Pat. No. 10,159,307.

(60) Provisional application No. 62/308,810, filed on Mar. 15, 2016.

(51) Int. Cl.

| | |
|---|---|
| ***A43B 13/12*** | (2006.01) |
| ***A43B 13/14*** | (2006.01) |
| ***A43B 13/18*** | (2006.01) |

(52) U.S. Cl.

CPC ..... *A43B 13/141* (2013.01); *A43B 13/186* (2013.01); *A43B 13/188* (2013.01); *A43B 13/206* (2013.01)

(56) References Cited

U.S. PATENT DOCUMENTS

| | | | | |
|---|---|---|---|---|
| 5,042,176 | A | 8/1991 | Rudy | |
| D336,772 | S | 6/1993 | Forland et al. | |
| 5,543,194 | A | 8/1996 | Rudy | |
| 5,598,645 | A | 2/1997 | Kaiser | |
| 5,669,161 | A | 9/1997 | Huang | |
| 5,832,630 | A | 11/1998 | Potter | |
| 6,009,637 | A | 1/2000 | Pavone | |
| 9,609,912 | B2 | 4/2017 | Holt et al. | |
| 10,159,307 | B2 * | 12/2018 | Case | A43B 13/12 |
| 11,051,582 | B2 * | 7/2021 | Case | A43B 13/186 |
| 11,712,085 | B2 * | 8/2023 | Case | A43B 13/186 36/29 |
| 2006/0137221 | A1 | 6/2006 | Dojan | |
| 2007/0277346 | A1 | 12/2007 | Schmidt | |
| 2011/0277346 | A1 | 11/2011 | Peyton et al. | |
| 2012/0174432 | A1 | 7/2012 | Peyton | |
| 2014/0230276 | A1 | 8/2014 | Campos, II et al. | |
| 2015/0272271 | A1 | 10/2015 | Campos, II et al. | |

FOREIGN PATENT DOCUMENTS

| | | | |
|---|---|---|---|
| EP | 1745710 | A2 | 1/2007 |
| EP | 2609823 | A1 | 7/2013 |

OTHER PUBLICATIONS

Korean Intellectual Property Office, Office Action for KR Application No. 10-2018-7029510, mailed Oct. 28, 2019.

Japan Patent Office, Office Action for JP Application No. 2018-548890, mailed Dec. 3, 2019.

USPTO, Non-Final Office Action for U.S. Appl. No. 16/217,279, mailed Oct. 15, 2020.

USPTO, Notice of Allowance and Fee(s) Due for U.S. Appl. No. 17/366,452, mailed Mar. 15, 2023.

USPTO, Non-Final Office Action for U.S. Appl. No. 17/366,452, mailed Dec. 6, 2022.

* cited by examiner

SOLE STRUCTURE FOR ARTICLE OF FOOTWEAR

CROSS REFERENCE TO RELATED APPLICATION

This application is a continuation of U.S. application Ser. No. 17/366,452, filed Jul. 2, 2021, which is a continuation of U.S. application Ser. No. 16/217,279, filed Dec. 12, 2018 which is a continuation of U.S. application Ser. No. 15/459,131, filed Mar. 15, 2017, which claims priority to U.S. Provisional Application Ser. No. 62/308,810, filed Mar. 15, 2016, the disclosures of which are hereby incorporated by reference in their entirety.

FIELD

The present disclosure relates generally to sole structures for articles of footwear and more particularly to sole structures incorporating a fluid-filled chamber having a plurality of fluid-filled segments.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled chamber to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a stroble attached to the upper and disposed between the midsole and the insole or sockliner.

Midsoles using fluid-filled chambers are generally configured as a chamber formed from two barrier layers of polymer material that are sealed or bonded together, and pressurized with a fluid such as air, and may incorporate tensile members within the chamber to retain the shape of the chamber when the chamber compresses resiliently under applied loads, such as during athletic movements. Generally, fluid-filled chambers are designed with an emphasis on balancing support for the foot and cushioning characteristics that relate to responsiveness as the fluid-filled chamber resiliently compresses under an applied load. The fluid-filled chamber as a whole, however, fails to adequately dampen oscillations by the foot as the fluid-filled chamber compresses to attenuate ground-reaction forces. Accordingly, creating a midsole from a fluid-filled chamber that dampens foot oscillation and provides acceptable cushioning for the foot while attenuating ground-reaction forces is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
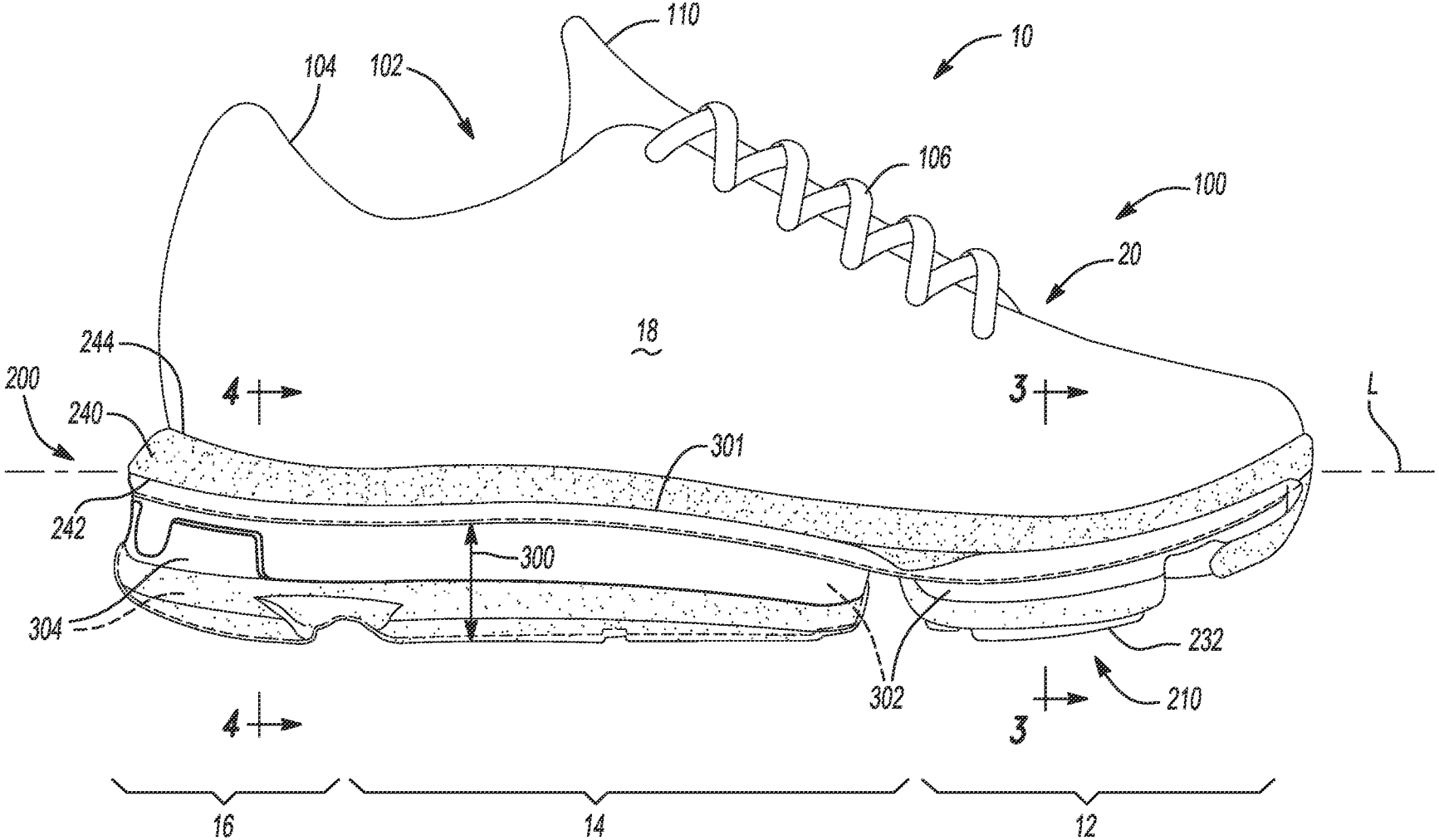
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article footwear having an upper. The sole structure includes a heel region, a forefoot region, a midfoot region disposed between the heel region and the forefoot region, and a fluid-filled chamber. The fluid-filled chamber includes a first barrier layer cooperating with a second barrier layer to define a first fluid-filled segment extending along a medial side of the sole structure within the heel region. A second fluid-filled segment extends along a lateral side of the sole structure within the heel region. A web area is disposed between and connecting the first fluid-filled segment and the second fluid-filled segment. The first barrier layer is attached to the second barrier layer within the web area.

Implementations of the disclosure may include one or more of the following optional features. In some implementations, the first fluid-filled segment and the second fluid-filled segment each include a ground-contacting surface. The web area may be recessed from the ground-contacting surface. The first fluid-filled segment may be fluidly coupled to the second fluid-filled segment. The fluid-filled chamber may further include a third fluid-filled segment extending around the heel region and fluidly coupled to the first fluid-filled segment and the second fluid-filled segment. The fluid-filled chamber may also include a fourth fluid-filled segment extending between and connected to the first fluid-filled segment and the second fluid-filled segment. Here, the fourth fluid-filled segment may extend between the medial side and the lateral side.

In some implementations, the web area is bounded by the first fluid-filled segment, the second fluid-filled segment, the third fluid-filled segment, and the fourth fluid-filled segment. The web area may further be disposed proximate to the upper. In some examples, the fluid-filled chamber includes a fifth fluid-filled segment extending from the first fluid-filled segment toward the lateral side of the sole structure. The chamber may also include a sixth fluid-filled segment extending from the second fluid-filled segment toward the medial side of the sole structure. The fifth fluid-filled segment may be substantially parallel to the sixth fluid-filled segment. The sixth fluid-filled segment may include a distal end that terminates at a location between the medial side and the lateral side. The distal end may taper in a direction toward the upper. In some examples, the fifth fluid-filled segment extends continuously from the medial side to the lateral side. The fifth fluid-filled segment may include a distal end that terminates at a location between the medial side and the lateral side within the forefoot region. The distal end of the fifth fluid-filled segment may taper in a direction toward the upper.

The sole structure may include an over mold portion extending over a portion of the fluid-filled chamber. The over mold portion may extend over the heel region, the midfoot region, and/or the forefoot region. The over mold portion may be bonded to the second barrier layer and may include at least one of a different thickness, a different hardness, and a different material than the second barrier layer.

Another aspect of the disclosure provides a sole structure for an article footwear having an upper. The sole structure includes a heel region, a forefoot region, a midfoot region disposed between the heel region and the forefoot region, and a fluid-filled chamber. The fluid-filled chamber includes a first barrier layer cooperating with a second barrier layer to define a first fluid-filled segment extending continuously between a medial side of the sole structure and a lateral side of the sole structure within the forefoot region. A second fluid-filled segment extends continuously between the medial side of the sole structure and the lateral side of the sole structure within the forefoot region. A web area is disposed between and connecting the first fluid-filled segment and the second fluid-filled segment, the first barrier layer being attached to the second barrier layer within the web area.

This aspect may include one or more of the following optional features. In some implementations, the first fluid-filled segment and the second fluid-filled segment each include a ground-contacting surface. The web area may be recessed from the ground-contacting surface. The first fluid-filled segment may be fluidly coupled to the second fluid-filled segment. In some examples, the fluid-filled chamber includes a third fluid-filled segment extending along one of the medial side and the lateral side and fluidly coupled to the first fluid-filled segment and the second fluid-filled segment. The first fluid-filled segment and the second fluid-filled segment may converge toward one another in a direction extending from the one of the medial side and the lateral side to the other of the medial side and the lateral side.

In some examples, the web area extends between the first fluid-filled segment and the second fluid-filled segment at the other of the medial side and the lateral side. The first fluid-filled segment may be spaced apart from the second fluid-filled segment at the other of the medial side and the lateral side. The web area may extend continuously from the third fluid-filled segment to the other of the medial side and the lateral side. The web area may be bounded by the first fluid-filled segment, the second fluid-filled segment, the third fluid-filled segment, and the other of the medial side and the lateral side. The web area may be disposed proximate to the upper.

In some implementations, the fluid-filled chamber includes a fourth fluid-filled segment extending from the second fluid-filled segment along the other of the medial side and the lateral side. The fluid-filled chamber may include a fifth fluid-filled segment fluidly coupled to the fourth fluid-filled segment and extending from the one of the medial side and the lateral side toward the other of the medial side and the lateral side. The fourth fluid-filled segment may be substantially parallel to the fifth fluid-filled segment. The fifth fluid-filled segment may include a distal end that terminates at a location between the medial side and the lateral side. The distal end may taper in a direction toward the upper.

The sole structure may include an over mold portion extending over a portion of the fluid-filled chamber. The over mold portion may extend over the heel region. The over mold portion may extend over the midfoot region. The over mold portion may extend into the forefoot region. The over mold portion may be bonded to the second barrier layer and include at least one of a different thickness, a different hardness, and a different material than the second barrier layer.

In yet another aspect, the disclosure provides a sole structure for an article of footwear having an upper. The sole structure includes a heel region, a forefoot region, a midfoot region disposed between the heel region and the forefoot region, and a fluid-filled chamber. The fluid-filled chamber includes a first barrier layer cooperating with a second barrier layer to define a first fluid-filled segment extending along one of a medial side of the sole structure and a lateral side of the sole structure from the heel region to the forefoot region. A second fluid-filled segment extends from the one of the medial side and the lateral side to the other of the medial side and the lateral side. A third fluid-filled segment extends from the other of the medial side and the lateral side to the one of the medial side and the lateral side.

This aspect may include one or more of the following optional features. In some implementations, the first fluid-filled segment and the second fluid-filled segment each include a ground-contacting surface. The ground-contacting surface may extend uninterrupted from the heel region to the forefoot region along the first fluid-filled segment, the second fluid-filled segment, and the third fluid-filled segment. The second fluid-filled segment may extend continuously from the one of the medial side and the lateral side to the other of the medial side and the lateral side. The third fluid-filled segment may extend continuously from the other of the medial side and the lateral side to the one of the medial side and the lateral side.

In some examples, the fluid-filled chamber includes a fourth fluid-filled segment extending along the other of the medial side and the lateral side. The fourth fluid-filled segment may also extend between and fluidly couples the second fluid-filled segment and the third fluid-filled segment. The web area may be recessed from a ground-contacting surface of the fluid-filled chamber. The second fluid-filled segment and the third fluid-filled segment may converge toward one another in a direction extending from the other of the medial side and the lateral side to the one of the medial side and the lateral side. The web area may extend between the second fluid-filled segment and the third fluid-filled segment at the one of the medial side and the lateral side. The second fluid-filled segment may be spaced apart from the third fluid-filled segment at the one of the medial side and the lateral side In some implementations, the web area extends continuously from the fourth fluid-filled segment to the other of the medial side and the lateral side. The web area may be bounded by the second fluid-filled segment, the third fluid-filled segment, the fourth fluid-filled segment, and the one of the medial side and the lateral side. The web area may be disposed proximate to the upper.

The fluid-filled chamber may include a fifth fluid-filled segment extending from the third fluid-filled segment along the one of the medial side and the lateral side. The fluid-filled chamber may further include a sixth fluid-filled segment fluidly coupled to the fifth fluid-filled segment and extending from the other of the medial side and the lateral side toward the one of the medial side and the lateral side. The fifth fluid-filled segment may be substantially parallel to the sixth fluid-filled segment. The sixth fluid-filled segment may further include a distal end that terminates at a location between the medial side and the lateral side. In some examples, the distal end tapers in a direction toward the upper.

The sole structure may also include an over mold portion extending over a portion of the fluid-filled chamber. The over mold portion may extend over the heel region. The over mold portion may also extend over the midfoot region. The over mold portion may further extend into the forefoot region. The over mold portion may be bonded to the second barrier layer and include at least one of a different thickness, a different hardness, and a different material than the second barrier layer.

Referring to FIG. 1, an article of footwear 10 includes an upper 100 and a sole structure 200 attached to the upper 100. The article of footwear 10 may be divided into one or more regions. The regions may include a forefoot region 12, a mid-foot region 14 and a heel region 16. The forefoot region 12 may correspond with toes and joints connecting metatarsal bones with phalanx bones of a foot. The mid-foot region 14 may correspond with an arch area of the foot, and the heel region 16 may correspond with rear portions of the foot, including a calcaneus bone. The footwear 10 may include lateral and medial sides 18, 20, respectively, corresponding with opposite sides of the footwear 10 and extending through the regions 12, 14, 16.

The upper 100 includes interior surfaces that define an interior void 102 configured to receive and secure a foot for support on the sole structure 200. An ankle opening 104 in the heel region 16 may provide access to the interior void 102. For example, the ankle opening 104 may receive a foot to secure the foot within the void 102 and facilitate entry and removal of the foot from and to the interior void 102. In some examples, one or more fasteners 106 extend along the upper 100 to adjust a fit of the interior void 102 around the foot and accommodate entry and removal therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may include a tongue portion 110 that extends between the interior void 102 and the fasteners 106. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

In some implementations, the sole structure 200 includes an outsole 210, a fluid-filled chamber 300, a midsole 240, and a stroble 220 (FIGS. 2-4) arranged in a layered configuration. The sole structure 200 (e.g., the outsole 210, the fluid-filled chamber 300, the midsole 240, and the stroble 220) defines a longitudinal axis L. For example, the outsole 210 engages with a ground surface during use of the article of footwear 10 and the fluid-filled chamber 300 is disposed between the outsole 210 and the midsole 240, which attaches to the upper 100 and/or the stroble 220. The fluid-filled chamber 300 may attach to the upper 100 by way of the midsole 240 and the outsole 210 may attach to an opposite side of the fluid-filled chamber 300 than the midsole 240. In some examples, the sole structure 200 may also incorporate additional layers such as an insole 216 (FIGS. 3 and 4) or sockliner that may be disposed upon the stroble 220 and reside within the interior void 102 of the upper 100 to receive a plantar surface of the foot to enhance the comfort of the footwear 10.

Figure 3:
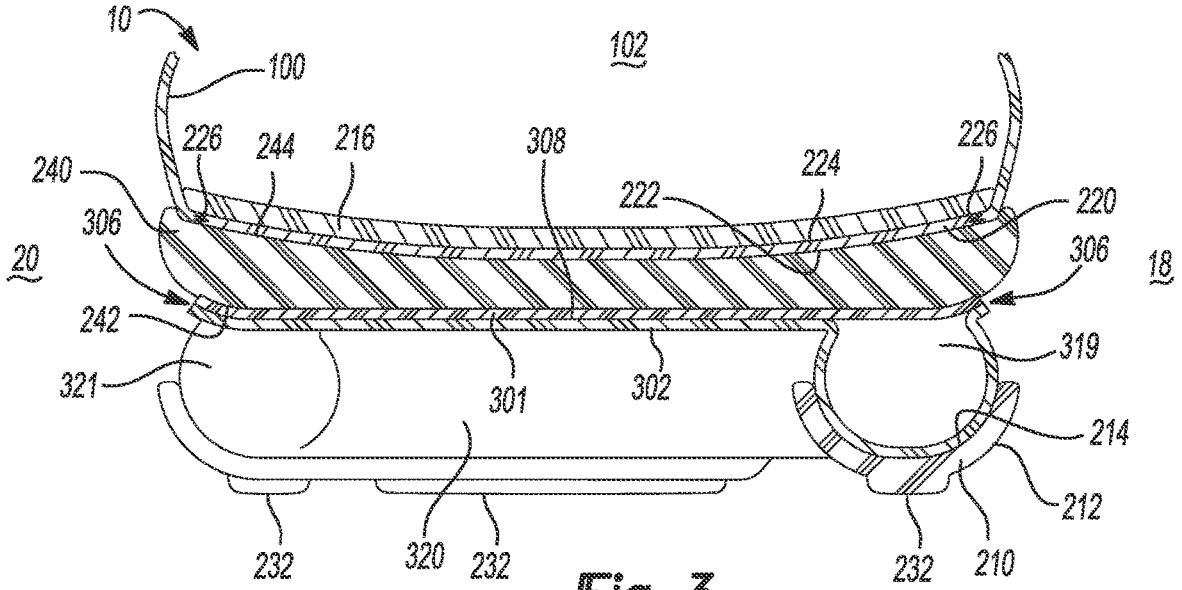
FIG. 3 is a cross-sectional view taken along line 3-3 of FIG. 1 showing a fluid-filled segment within a forefoot region of a sole structure and extending continuously between a lateral side of the sole structure and the medial side of a sole structure.
Figure 4:
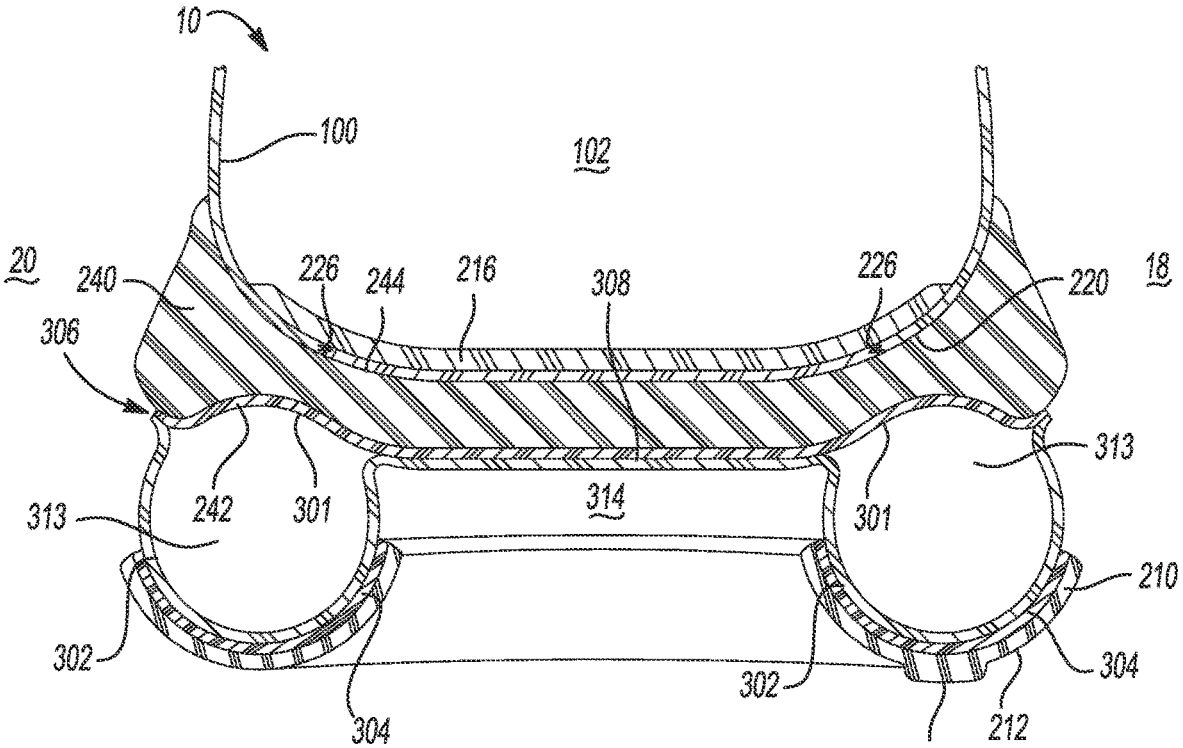
FIG. 4 is a cross-sectional view taken along line 4-4 of FIG. 1 showing an over mold portion attached to fluid-filled segments within a heel region of a sole structure.

The fluid-filled chamber 300 is formed from an upper barrier layer 301 (hereinafter 'upper layer 301') and a lower barrier layer 302 (hereinafter 'lower layer 302') during a molding or thermoforming process. In some examples, the upper and lower layers 301 and 302 are formed from one or more polymer materials. The upper layer 301 and the lower layer 302 are joined together around the periphery of the sole structure 200 to define a flange 306 (FIGS. 3 and 4). Moreover, the upper layer 301 and the lower layer 302 are joined together at various locations between the lateral side 18 of the sole structure 200 and the medial side 20 of the sole structure 200 to define a web area 308 (FIGS. 3 and 4).

In some implementations, the fluid-filled chamber 300 includes a plurality of fluid-filled segments 311, 312, 313, 314, 315, 316, 317, 318, 319, 320, 321, 322, 323, 324 (see FIG. 5) each containing a pressurized fluid (e.g., air) to provide cushioning and stability for the foot during use of the footwear 10. The fluid-filled segments 311-324 may all be in fluid communication with one another and at least one of the fluid-filled segments 311-324 may have a different length than the other fluid-filled segments 311-324. The fluid-filled segments 311-324 are formed in areas of the sole structure 200 where the upper layer 301 and the lower layer 302 are separated and spaced apart from one another to define respective voids for enclosing the pressurized fluid (e.g., air). As such, the flange 306 and the web area 308 correspond to areas of the fluid-filled chamber 300 where the upper layer 301 and the lower layer 302 are joined and bonded, and cooperate to bound and define a perimeter of each fluid-filled segment 311-324 to thereby seal the pressurized fluid therein. Accordingly, the fluid-filled segments 311-324 may be disposed within corresponding ones of the regions 12, 14, 16 of the sole structure 200 and may be spaced apart from one another by the web area 308. In other words, the one or more fluid-filled segments 311-324 may cooperate to bound corresponding regions of the web area 308.

Figure 5:
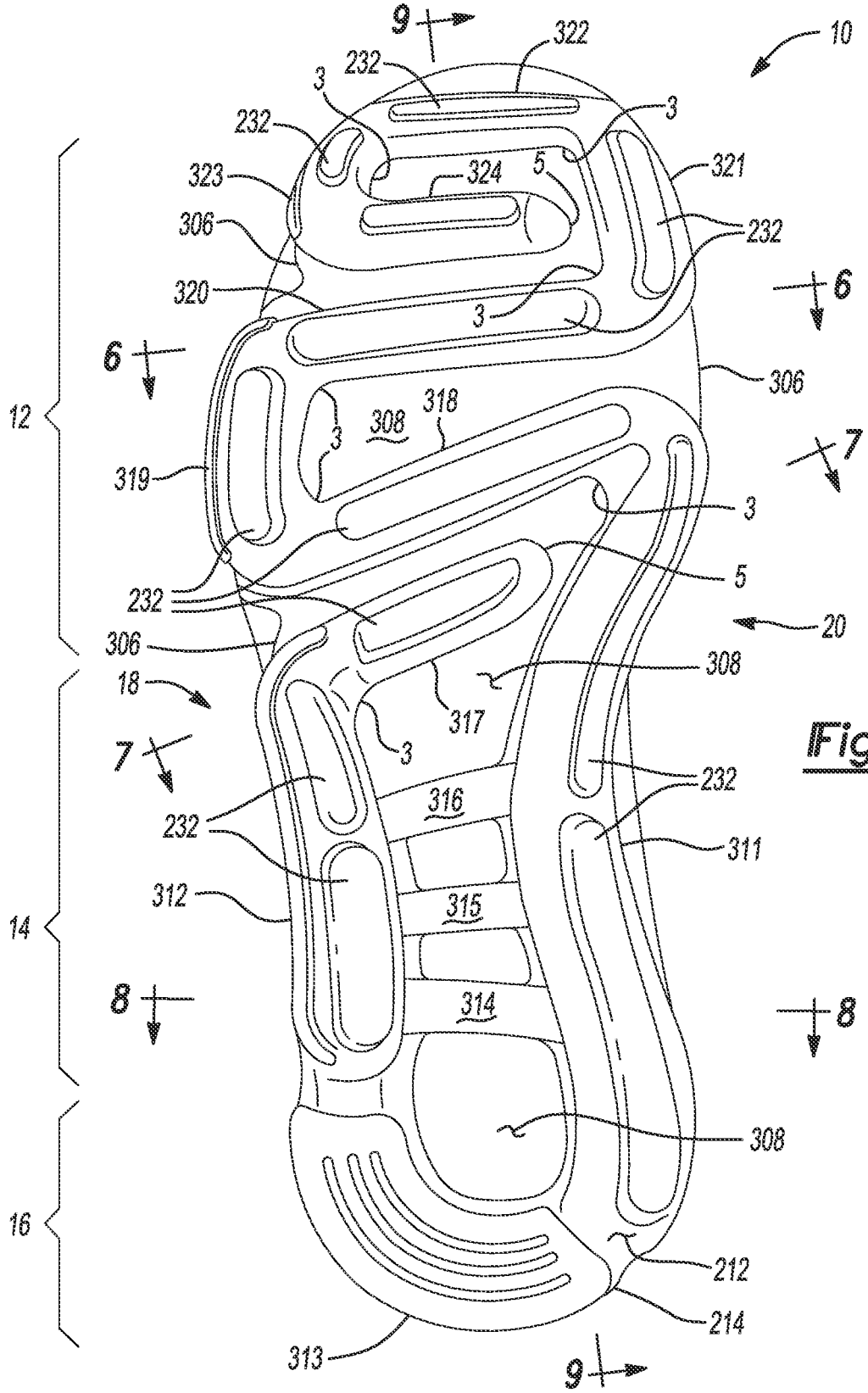
FIG. 5 is a bottom perspective view of the article of footwear of FIG. 1 showing a geometry and configuration of a plurality of fluid-filled segments associated with a fluid-filled chamber of a sole structure.

The geometry and configuration of the fluid-filled segments 311-324 is shown with reference to a bottom perspective view of the footwear 10 shown in FIG. 5. In other implementations, one or more cushioning materials, such as polymer foam and/or particulate matter, are enclosed by one or more of the fluid-filled segments 311-324 in place of, or in addition to, the pressurized fluid to provide cushioning for the foot. In these implementations, the cushioning materials may provide a soft-type cushioning when compressed under an applied load.

Each fluid-filled segment 311-324 may define a substantially tubular cross-sectional shape and a thickness that extends substantially perpendicular to the longitudinal axis L of the sole structure 200 between the upper layer 301 of the chamber 300 and the lower layer 302 of the chamber 300. As such, the thickness of each fluid-filled segment 311-324 is defined by a distance the lower layer 302 protrudes away from the upper layer 301 in a direction away from the upper 100. At least two of the fluid-filled segments 311-324 may define different thicknesses. For example, one or more fluid-filled segments 311-324 disposed in the heel region 16 may be associated with greater thicknesses than thicknesses associated one or more fluid-filled segments 311-324 disposed in the forefoot region 12.

In some implementations, at least two of the fluid-filled segments 311-324 extend along the lateral side 18 of the sole structure 200 while at least two other fluid-filled segments 311-324 extend along the medial side 20 of the sole structure 200. Moreover, some of the fluid-filled segments 311-324 extend between the lateral side 18 of the sole structure 200 and the medial side 20 of the sole structure 200. For instance, at least one fluid-filled segment 311-324 may extend continuously from one of the lateral side 18 and the medial side 20 to the other one of the lateral side 18 and the medial side 20. Additionally or alternatively, at least one of the fluid-filled segments 311-324 extends from one of the lateral side 18 and the medial side 20 to a distal end 5 that terminates at a location between the medial side 20 and the lateral side 18. Here, the distal end(s) 5 may taper in a direction toward the upper 100, i.e., toward the upper layer 302 of the fluid-filled chamber 300. In some examples, the fluid-filled chamber 300 includes a serpentine shape defined by the fluid-filled segments 311-324 in fluid communication with one another and extending through the regions 12, 14, 16 and between the lateral and medial sides 18 and 20 of the sole structure 200.

The fluid-filled segments 311-324 associated with the fluid-filled chamber 300 may cooperate to enhance the functionality and cushioning characteristics that a conventional midsole provides, while simultaneously providing increased stability and support for the foot by dampening oscillations by the foot that occur in response to a ground-reaction force during use of the footwear 10. For instance, an applied load to the sole structure 200 during forward movements, such as walking or running movements, may cause some of the fluid-filled segments 311-324 to compress to provide cushioning for the foot by attenuating the ground-reaction force, while other fluid-filled segments 311-324 may retain their shape to impart stability and support characteristics that dampen foot oscillations relative to the footwear 10 responsive to the initial impact of the ground-reaction force.

Moreover, one or more of the fluid-filled segments 311-324 may interact with the web area 308 within different regions 12, 14, 16 of the sole structure 200 to provide isolated areas of responsive-type cushioning. For example, fluid-filled segments 311-314 within the heel region 16 may bound a respective portion of the web area 308 to provide responsive-type cushioning in the heel region 16 by causing the segments 311-314 around the perimeter of the heel region 16 to absorb the initial impact of a ground-reaction force by creating a trampoline effect as the fluid-filled segments 311-314 compress in succession, and thereby provide a gradient responsive-type cushioning in the heel region 16.

Additionally, the geometry and positioning of the fluid-filled segments 311-324 (FIG. 5) along the sole structure 200 may enhance traction between the outsole 210 and the ground surface during forward movements as the outsole 210 rolls for engagement with the ground surface from the heel region 16 to the forefoot region 12, as well as during lateral movements as the outsole 210 rolls for engagement with the ground surface from one of the lateral side 18 and the medial side 20 to the other one of the lateral side 18 and the medial side 20.

Figure 2:
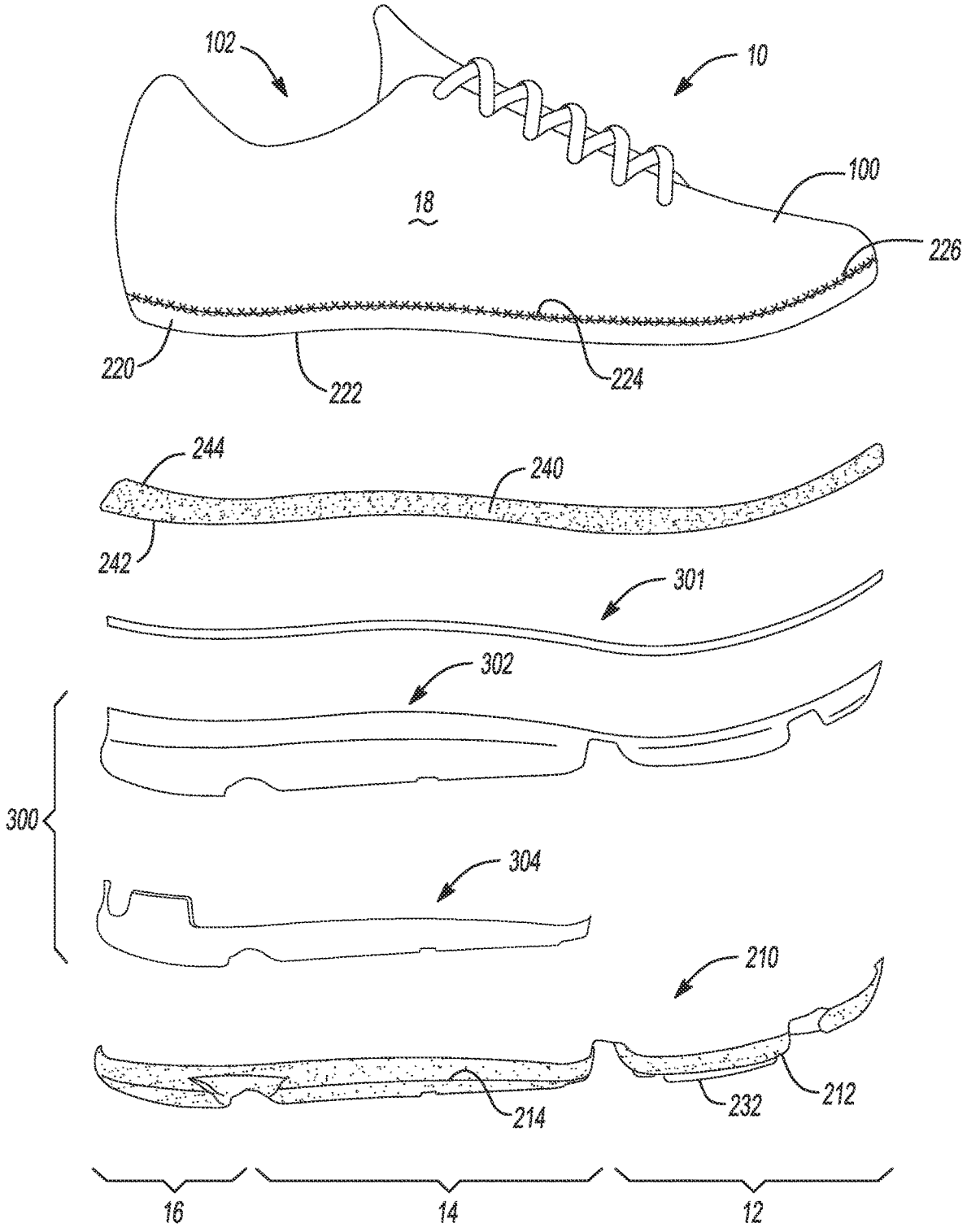
FIG. 2 is an exploded view of the article of footwear of FIG. 1 showing a sole structure having a midsole, a fluid-filled chamber, and an outsole arranged in a layered configuration.

FIG. 2 provides an exploded view of the article of footwear 10 of FIG. 1. The stroble 220 may include a bottom surface 222 and a footbed 224 disposed on an opposite side of the stroble 220 than the bottom surface 222. Stitching 226 or adhesives may secure the stroble 220 to the upper 100. The footbed 224 may be contoured to conform to a profile of the bottom surface (e.g., plantar) of the foot. In some examples, the insole 216 or sockliner (shown in FIGS. 3 and 4) may be disposed on the footbed 224 under the foot within at least a portion of the interior void 102 of the upper 100. The bottom surface 222 of the stroble 220 may oppose the midsole 240.

In some implementations, the midsole 240 is disposed between the bottom surface 222 of the stroble 220 and the upper layer 301 of the fluid-filled chamber 300. More particularly, the midsole 240 includes a bottom surface 242 and a top surface 244 disposed on an opposite side of the midsole 240 than the bottom surface 242. The top surface 244 of the midsole 240 joins with the bottom surface 222 of the stroble 220 and also extends around and joins with peripheral surfaces of the upper 100. The bottom surface 242 of the midsole 240 joins with the upper surface 301 of the fluid-filled chamber 300. Thus, the midsole 240 is operative as an intermediate layer to indirectly attach the upper layer 301 of the fluid-filled chamber 300 to the upper 100 by joining the top surface 244 of the midsole 240 to the upper 100 and/or bottom surface 222 of the stroble 220 and joining the bottom surface 242 to the upper layer 301 of the fluid-filled chamber 300, thereby securing the sole structure 200 (e.g., the outsole 210, the fluid-filled chamber 300, and the midsole 240) to the upper 100. Moreover, the midsole 240 of the footwear 10 may also reduce the extent to which the upper layer 301 extends onto the peripheral surfaces of the upper 100, and therefore increases durability of the footwear 10 by reducing the possibility of the upper layer 301 detaching from the upper 100 over extended use of the footwear 10.

Additionally, the midsole 240 may be contoured to conform to a profile of the bottom surface of the foot to provide cushioning and support for the foot. In some examples, the midsole 240 is formed from a slab of one or more polymer foam materials that compress resiliently under an applied load to cushion the foot by attenuating ground-reaction forces. In some implementations, compressibility by the plurality of fluid-filled segments 311-324 of the fluid-filled chamber 300 under an applied load provide a responsive-type cushioning while compressibility by the midsole 240 under an applied load provides a soft-type cushioning. Accordingly, the fluid-filled segments 311-324 and the midsole 240 may cooperate to provide gradient cushioning to the article of footwear 10 that changes as the applied load changes (i.e., the greater the load, the more the fluid-filled segments 311-324 are compressed and, thus, the more responsive the footwear 10 performs).

The upper layer 301 of the fluid-filled chamber 300 opposes and attaches (e.g., joins and bonds) to the bottom surface 242 of the midsole 240. The upper layer 301 may be formed from one or more polymer materials during a molding process or a thermoforming process and include an outer peripheral edge that extends upward upon an outer periphery of the midsole 240.

The lower layer 302 of the fluid-filled chamber 300 is disposed on an opposite side of the fluid-filled chamber 300 than the upper layer 301. As with the upper layer 301, the lower layer 302 may be formed from the same or different one or more polymer materials during the molding or thermoforming process. The lower layer 302 may include an outer peripheral edge that extends upward toward the upper 100 and bonds with the outer peripheral edge of the upper layer 301 to form the flange 306. In some implementations, the lower layer 302 defines a geometry (e.g., thicknesses, width, and lengths) of the plurality of fluid-filled segments 311-324 associated with the fluid-filled chamber 300. The lower layer 302 and the upper layer 301 may join and bond together in a plurality of discrete areas between the lateral side 18 and the medial side 20 of the fluid-filled chamber 300 to form portions of the web area 308 that bound and separate each fluid-filled segment 311-324. Thus, each fluid-filled segment 311-324 is associated with an area of the fluid-filled chamber 300 where the upper and lower layers 301 and 302 are not joined together and, thus, are separated from one another to form respective voids associated with each fluid-filled segment 311-324. In some implementations, adhesive bonding joins the upper layer 301 and the lower layer 302 to form the flange 306 and the web area 308. In other implementations, the upper layer 301 and the lower layer 302 are joined to form the flange 306 and web area 308 by thermal bonding.

In some implementations, the upper and lower layers 301 and 302 are formed by respective mold portions each defining various surfaces to define depressions associated with the fluid-filled segments 311-324 and pinched surfaces to define locations where the flange 306 is formed when the lower layer 302 and the upper layer 301 join and bond together. In some examples, one or both of the upper and lower layers 301 and 302 are heated to a temperature that facilitates shaping and bonding. In some examples, the layers 301 and/or 302 are heated prior to being located between their respective molds. In other examples, the mold may be heated to raise the temperature of the layers 301 and/or 302. In some implementations, a molding process used to form the fluid-filled chamber 300 incorporates vacuum ports within mold portions to remove air such that the upper and lower layers 301 and 302 are drawn into contact with respective mold portions. In other implementations, fluids such as air may be injected into areas between the upper and lower layers 301 and 302 such that pressure increases cause the layers 301 and 302 to engage with surfaces of their respective mold portions.

The thickness of the fluid-filled chamber 300 may be thicker in the heel region 16 than in the forefoot region 12. In some examples, thickness of the fluid-filled chamber 300 gradually decreases from the heel region 16 to the forefoot region 12 to provide a greater degree of cushioning for absorbing ground-reaction forces of greater magnitude that initially occur in the heel region 16 and lessen as the outsole 210 rolls for engagement with the ground surface.

In some implementations, an over mold portion 304 extends over a portion of the fluid-filled chamber 300 to provide increased durability and resiliency for the fluid-filled chamber 300 when under applied loads. The over mold portion 304 may extend over the heel region 16 by attaching to the second barrier layer 302 to provide increased durability and resiliency for the fluid-filled chamber 300 within the heel region 16 where the separation distance between the lower layer 302 and the upper layer 301 are larger to define the thicker fluid-filled chamber 300 in the heel region 16. Additionally or alternatively, the over mold portion 304 may extend over the mid-foot region 14 and may also extend into the forefoot region 12. In some examples the over mold portion 304 is bonded to the lower layer 302 and includes at least one of a different thickness, a different hardness, and a different material than the second layer 301. The over mold portion 304 is limited to only attaching to areas of the lower layer 302 that partially define the fluid-filled segments 311-317 residing in the heel and mid-foot regions 16 and 14 and, therefore, the over mold portion 304 is absent from attaching to the flange 306 and web area 308 wherein the lower layer 302 joins with the upper layer 301. Accordingly, the over mold portion 304 may define a plurality of segments each defining a shape that generally conforms to the shape of the respective fluid-filled segment 311-317 attached therewith. The plurality of segments of the over mold portion 304 are continuous in some configurations.

In some examples, the outsole 210 includes a ground-engaging surface 212 and an opposite inner surface 214 that attaches to the over mold portion 304 and areas of the lower layer 302 that define the fluid-filled segments 318-324 where the over mold portion 304 is absent, i.e., in the forefoot region 12. Accordingly, as with the over mold portion 304, the outsole 210 may include a plurality of segments each defining a shape that conforms to the shape of a respective fluid-filled segment 311-324, whereby the outsole 210 is absent in regions between the fluid-filled segments 311-324 to thereby expose the flange 306 and web area 308 of the fluid-filled chamber 300. The outsole 210 generally provides abrasion-resistance and traction with the ground surface and may be formed from one or more materials that impart durability and wear-resistance, as well as enhance traction with the ground surface. For example, rubber may form at least a portion of the outsole 210. The ground-engaging surface 212 may define a plurality of contact pads 232 that protrude from the ground-engaging surface 212 in a direction away from the upper 100 and extend in parallel along the lengths of fluid-filled segments 311, 312, 317-324 to impart traction and stability in the mid-foot and forefoot regions 14 and 12. The contact pads 232 may also cause the bottom surface of the foot to reside higher above the ground surface.

FIG. 3 provides a cross-sectional view taken along line 3-3 of FIG. 1 showing the fluid-filled segment 319 of the fluid-filled chamber 300 extending along the lateral side 18 of the sole structure 200 within the forefoot region 12. The stroble 220 secures to the upper 100 via stitching 226 or other securing techniques, while the insole 216 or sock liner resides in the interior void 102 upon the footbed 224 of the stroble 220. The bottom surface 222 of the stroble 220 attaches to the top surface 244 of the midsole 240, while peripheral edges of the midsole 240 also extend upon, and attach to, peripheral surfaces of the upper 100. FIG. 3 shows the upper layer 301 attaching to the bottom surface 242 of the midsole 240 and having peripheral edges extending toward the upper 100 and joining with the peripheral edges of the lower layer 302 to form the flange 306 around the perimeter of the fluid-filled chamber 300. Here, the lower layer 302 may extend toward the upper 100 and join with the upper layer 301 to form a region of the web area 308 that cooperates with the flange 306 at the lateral side 18 to define and bound the fluid-filled segment 319 that extends along the lateral side 18. The web area 308 may uniformly and continuously extend from the fluid-filled segment 319 to the flange 306 at the medial side 20. FIG. 3 also shows the fluid-filled segment 320 continuously extending from the fluid-filled segment 319 at the lateral side 18 of the sole structure 200 to the fluid-filled segment 321 at the medial side 20 of the sole structure 200.

The outsole 210 attaches to and conforms in shape with one or more of the fluid-filled segments 311-324. In some examples, at least one of the fluid-filled segments 311-324 defines a linear ridge extending along its length that is configured to receive and support a respective segment of the outsole 210. FIG. 3 shows the ground-engaging surface 212 of the outsole 210 including the contact pad 232 that extends in parallel along the lengths of the fluid-filled segments 319, 320, 321 of the fluid-filled chamber 300 to enhance traction with the ground surface.

FIG. 4 provides a cross-sectional view taken along line 4-4 of FIG. 1 showing the lower layer 302 extending toward the upper 100 and joining with the upper layer 301 to form two regions of the web area 308 between the flange 306 at the lateral side 18 and the medial side 20 to define and bound the portions of the fluid-filled segment 313 and the fluid-filled segment 314 disposed therebetween. In some examples, the fluid-filled segment 313 protrudes outward from the upper 100 along the lateral side 18 and the medial side 20. Whereas the upper layer 301 is generally concave and rounded to conform to the shape of the foot during use of the footwear 10, the lower layer 302 is more contoured with the fluid-filled segment 313 extending or protruding away from the flange 306 and web area 308. Thus, the fluid-filled segment 313, as well as the other fluid-filled segments 311-312 and 314-324, protrudes away from the upper 100 and toward the outsole 210 to form an independent support or cushioning element in the sole structure 200.

The over mold portion 304 may attach to portions of the lower layer 302 in regions where the fluid-filled segment 313 protrudes away from the upper 100 and toward the outsole 210 to provide increased durability and resiliency for the fluid-filled segment 313. More particularly, the over mold portion 304 is contoured to the rounded surfaces of the fluid-filled segment 313. In some examples, the lower layer 302 of the fluid-filled chamber 300 is formed to include a reduced thickness along portions where the over mold portion 304 is attached thereto. The inner surface 214 of the outsole 210 attaches to the over mold portion 304, whereby the web area 308 is recessed relative to the ground-engaging surface 212 of the outsole 210.

In some examples, the contact pad 232 protrudes from the ground-engaging surface 212 that attaches to the over mold portion 214 covering the fluid-filled segment 313 at the lateral side 18 relative to the view of FIG. 4. In some implementations, the portion of the fluid-filled segment 313 extending along the lateral side 18 and the other portion of the fluid-filled segment 313 extending along the medial side 20 each include semi-tubular cross-sectional shapes relative to the view of FIG. 4 to facilitate inward and/or outward rolling of the sole structure 200 during lateral movements, while the fluid-filled segment 314 disposed between the lateral side 18 and the medial side 20 may include a reduced thickness to allow the fluid-filled segment 313 to absorb the initial impact of a ground-reaction force and thereby compress before the ground-reaction force is applied to the fluid-filled segment 314. As such, a trampoline effect is created in the center of the heel region 16 as the fluid-filled segments 313 and 314 compress in succession, thereby providing gradient responsive-type cushioning for the calcaneus bone (e.g., heel bone) of the foot. The fluid-filled segments 313 and 314 each containing the pressurized fluid (e.g., air) may be in fluid communication by the fluid-filled segments 311 and 312 extending along respective ones of the medial side 18 and the lateral side 18. In some configurations, the over mold portion 304 attaches the fluid-filled segment 314 (and also the fluid-filled segments 315 and 316). In other configurations, the over mold portion 304 is absent from at least one of the fluid-filled segments 314, 315, 316.

FIG. 5 provides a bottom perspective view of the article of footwear 10 of FIG. 1 showing the geometry and positioning of the fluid-filled chamber 300 disposed within the sole structure 200. The upper layer 301 and the lower layer 302 include barrier layers for the fluid-filled chamber 300 by joining together and bonding at a plurality of discrete locations to form the flange 306 extending around the periphery of the sole structure 200 and the web area 308 extending between the lateral and medial sides 18 and 20 of the sole structure 200. The flange 306 and web area 308 are disposed proximate to the upper 100 and, thus, are recessed relative to the ground-engaging surface 212 of the outsole 210. The flange 306 and web area 306 may cooperate to bound and extend around each of the fluid-filled segments 311-324 to seal the fluid (e.g., air) within the segments 311-324. In some examples, regions of the web area 308 are bounded entirely by fluid-filled segments while other regions of the web area 308 are bounded by a combination of fluid-filled segments and the flange 306 along the lateral side 18 or the medial side 20. In some configurations, regions of the web area 308 define flexion zones to facilitate flexing of the footwear 10 as the outsole 210 rolls for engagement with the ground surface. FIG. 5 shows no portion of the web area 308 extending continuously between the lateral side 18 and the medial side 20.

In some implementations, the fluid-filled segments 311-324 are in fluid communication with one another to form a unitary pressure system for the fluid-filled chamber 300 that directs the fluid through the segments 311-324 when under an applied load as the segments 311-324 compress or expand to provide cushioning, as well as stability and support, by attenuating ground-reaction forces especially during forward running movements of the footwear 10. For example, the fluid-filled segments 311-313 and 317-324 may cooperate to define a unitary serpentine shape for the fluid-filled chamber 300 that extends between the distal ends 5 of the fluid-filled segment 324 disposed in the forefoot region 12 and the fluid-filled segment 317 disposed within the mid-foot region 14. More particularly, the unitary serpentine shape of the fluid-filled chamber 300 extends along the longitudinal axis L of the sole structure 200 and includes segments extending along the lateral side 18, segments extending along the medial side 20, segments extending continuously between the lateral side 18 and the medial side 20, as well as segments extending toward the medial side 20 to distal ends 5 that terminate at locations between the medial side 20 and the lateral side 18.

In some configurations, at least two adjacent fluid-filled segments 311-324 are connected to one another at a bend 3 or turn, whereby each of the segments connected by the corresponding bend 3 extend in different directions from one another. Each bend 3 is associated with an internal radius extending toward the periphery of the sole structure 200. In some examples, the radius of each bend 3 is at least 3 mm. Moreover, each bend 3 is disposed proximate to the periphery of the sole structure 200 on an opposite side of the respective fluid-filled segment 311-324 than the flange 306. By positioning the bends 3 on opposite sides of the fluid-filled segments than the flange 306, collapsing by the fluid-filled segments 310-340 is prevented during directional shifts between loads applied to the sole structure 200. Optionally, one or more of the segments 311-324 may be fluidly isolated from the other segments 311-324 so that at least one of the segments 311-324 can be pressurized differently.

In some configurations, the fluid-filled segment 311 extends along the medial side 20 of the sole structure 200 within the heel region 16, the fluid-filled segment 312 extends along the lateral side 18 of the sole structure 200 within the heel region 16, and the fluid-filled segment 313 extends around the heel region 16 and fluidly couples to the fluid-filled segments 311 and 312. Thus, the fluid-filled segment 313 may generally define a horse-shoe shape that fluidly couples to the fluid-filled segments 311 and 312 at respective ones of the medial side 20 and the lateral side 18. In some examples, the fluid-filled segment 311 includes a length greater than a length of the fluid-filled segment 312. For instance, the fluid-filled segment 311 may extend a greater extent from the heel region 16 toward the forefoot portion 12 than the fluid-filled segment 312. In some examples, the fluid-filled segment 311 partially extends into the forefoot portion 12.

In some implementations, the fluid-filled segment 314 extends between and connects to the fluid-filled segments 311 and 312. For instance, the fluid-filled segment 314 may extend from the lateral side 18 to the medial side 20 in a direction substantially perpendicular to the longitudinal axis L of the sole structure 200. Accordingly, the fluid-filled segment 314 fluidly connects to the fluid-filled segments 311 and 312 and provides fluid communication between the fluid-filled segments 311 and 312. The web area 308, i.e., formed where the lower layer 302 attaches to the upper layer 301, may extend between and connect the fluid-filled segments 311-314 within the heel region 16. As such, the fluid-filled segments 311-314 cooperate to bound the web area 308 within the heel region 16, whereby the web area 308 is disposed proximate to the upper 100 and recessed relative to the ground-engaging surface 212 of the outsole 210 attached over the fluid-filled segments 311-314

In some examples, one or more additional fluid-filled segments 315 and/or 316 extend between and connect to the fluid-filled segments 311 and 312 to define a ladder configuration for the fluid-filled chamber 300 within at least a portion of the mid-foot region 14. Here, the plurality of fluid-filled segments 314-316 extend substantially parallel to one another and in a direction substantially perpendicular to the longitudinal axis L of the sole structure 200 to provide stability and support for the foot by mitigating torsional forces acting upon the fluid-filled segments 311, 312, 313 during use of the footwear 10. Moreover, the segments 314-316 may cooperate with the segments 311 and 312 to provide spaced-apart regions of the web area 308. For instance, fluid-filled segments 311-314 may cooperate to bound a first web area 308 within the heel region 16, the fluid-filled segments 311, 312, 315, 316 may cooperate to bound a second web area 308 within the mid-foot region 14, and the fluid-filled segments 311, 312, 314, 315 may cooperate to bound a third web area 308 within a region between the first and second web areas 308. Accordingly, the web area 308 may be segmented between the lateral side 18 and the medial side 20 of the sole structure 200 to provide torsional support for the fluid-filled segments 311 and 312, and thereby dampen foot oscillation relative to the footwear 10, as the outsole 210 rolls for engagement with the ground surface from the heel region 16 to the forefoot region 12.

In some implementations, the fluid-filled segment 311 includes a length greater than a length of the fluid-filled segment 312. For instance, the fluid-filled segment 311 along the medial side 20 may extend a greater extent from the heel region 16 toward the forefoot portion 12 than the fluid-filled segment 312. The fluid-filled segment 311 may partially extend into the forefoot portion 12. In some implementations, fluid-filled segment 318 extends from the fluid-filled segment 311 at an opposite end of the fluid-filled segment 311 than the fluid-filled segment 313 in a direction toward the lateral side 18 of the sole structure 200, while fluid-filled segment 317 extends from the fluid-filled segment 312 at an opposite end of the fluid-filled segment 312 than the fluid-filled segment 313 in a direction toward the medial side 20 of the sole structure 200.

In some examples, the over mold portion 304 attaches to the portions of the lower layer 302 that define the fluid-filled segments 311-316 and is absent from the fluid-filled segments 317 and 318. As the fluid-filled segment 311 may extend a further distance from the heel region 16 than the fluid-filled segment 312, the fluid-filled segment 318 extending therefrom may be disposed further from the heel region 14 than the fluid-filled segment 317. The fluid-filled segment 317 may include a distal end 5 that terminates at a location between the medial side 20 and the lateral side 18, whereas the fluid-filled segment 318 may extend continuously from the medial side 20 to the lateral side 18. In some configurations, the distal end 5 of the fluid-filled segment 317 tapers in a direction toward the upper 100, and thereby allows the distal end 5 to operate as an anchor point for the respective fluid-filled segment 317, as well as an anchor point for the fluid-filled chamber 300 as a whole, for retaining the shape thereof when loads such as shear forces are applied thereto.

In some examples, the fluid-filled segments 317 and 318 are substantially parallel with one another and compress in succession as the outsole 210 rolls for engagement with the ground surface while the footwear 10 is performing a running movement to provide cushioning for the foot. The web area 308 may separate the fluid-filled segments 317 and 318 from one another such that the web area 308 is bounded by the fluid-filled segments 311, 317, 318 and the flange 306 at the lateral side 18 of the sole structure 200. In some implementations, the web area 308 separates the fluid-filled segments 317 and 318 that extend substantially parallel to one another to define a flexion zone between the mid-foot region 14 and the forefoot region 12.

In some implementations, fluid-filled segment 320 is disposed within the forefoot region 12 and extends continuously from the lateral side 18 of the sole structure 200 to the medial side 20 of the sole structure 200. The fluid-filled segment 319 may extend along the lateral side 18 of the sole structure 200 from the fluid-filled segment 318 in a direction away from the heel region 315 to fluidly couple the fluid-filled segments 318 and 320 that each extend continuously between the lateral side 18 and the medial side 20. In some scenarios, the fluid-filled segment 320 is convergent with the fluid-filled segment 318. In these scenarios, the fluid-filled segments 318 and 320 converge toward one another in a direction extending from the lateral side 18 to the medial side 20. While the fluid-filled segment 319 extends between the convergent fluid-filled segments 318 and 320 at the lateral side 18, the fluid-filled segments 318 and 320 are spaced apart from one another at the medial side 18. More particularly, the web area 308 and the flange 306 along the medial side 20 of the sole structure 200 cooperate to separate the fluid-filled segment 320 from the fluid-filled segment 318. For instance, FIG. 5 shows the web area 308 extending between the fluid-filled segments 318 and 320 and extending continuously from the fluid-filled segment 319 at the lateral side 18 to the flange 306 formed at the medial side 20 of the sole structure 200. The fluid-filled segments 318 and 320 converging in the direction extending from the lateral side 18 to the medial side 20, as well as the web area 308 separating the fluid-filled segments 318 and 320 at the medial side 20, allow the fluid-filled segments 318 and 320 to compress under an applied load to provide cushioning for the metatarsal bone by attenuating ground-reaction forces during running movements, while simultaneously dampening oscillation by the foot while the fluid-filled segments 318 and 320 are under compression.

Moreover, fluid-filled segment 321 may extend along the medial side 20 from the fluid-filled segment 320 in the direction away from the heel region 16, fluid-filled segment 322 may extend from the fluid-filled segment 321 in a direction toward the lateral side 18, and fluid-filled segment 323 may extend along the lateral side 18 from the fluid-filled segment 322 in a direction toward the heel region 16. In some examples, the fluid-filled segment 323 extending along the lateral side 18 has a shorter length than the fluid-filled segment 321 extending along the medial side 20. In some implementations, fluid-filled segment 324 extends from the fluid-filled segment 323 in the direction toward the medial side 20 and includes a distal end 5 that terminates at a location between the lateral side 18 and the medial side 20. As with the distal end 5 of the fluid-filled segment 317 within the mid-foot region 14, the distal end 5 of the fluid-filled segment 324 within the forefoot region 12 may taper in the direction toward the upper 100 to operate as an anchor point for the fluid-filled segment 324 to retain the shape thereof when shear forces are applied thereto.

In some examples, the fluid-filled segment 322 is substantially parallel with the fluid-filled segment 320 and convergent with the fluid-filled segment 324 disposed between the fluid-filled segments 320 and 322. In these examples, the fluid-filled segment 324 converges with the fluid-filled segment 322 in a direction extending from the medial side 20 to the lateral side 18 and converges with the fluid-filled segment 320 in the direction extending from the lateral side 18 to the medial side 20. As with the web area 308 separating the fluid-filled segments 318 and 320 along the medial side 20, the web area 308 separates the fluid-filled segments 320 and 324 along the lateral side 18. Accordingly, the converging of the fluid-filled segments 320 and 324 in the direction extending from the lateral side 18 to the medial side 20, in addition to the web area 308 separating the segments 320 and 324 along the lateral side 18, allows the fluid-filled segments 318 and 320 to compress under an applied load to provide a responsive-type cushioning for the metatarsal-phalangeal joints of the foot at toe-off.

The fluid-filled segments 320 and 324 converging in the direction extending from the lateral side 18 to the medial side 20, as well as the web area 308 separating the fluid-filled segments 320 and 324 at the lateral side 18, allow the fluid-filled segments 320 and 324 to compress under an applied load to provide cushioning for the metatarsal-phalangeal joints by attenuating ground-reaction forces during running movements, while simultaneously dampening oscillations by the foot while the fluid-filled segments 320 and 324 are under compression. The ground-engaging surface 212 of the outsole 210 may extend uninterrupted from the heel region 16 to the forefoot region 12 and along the fluid-filled segments 317, 312, 313, 311, 318, 319, 320, 321, 322, 323, 324.

Figure 6:
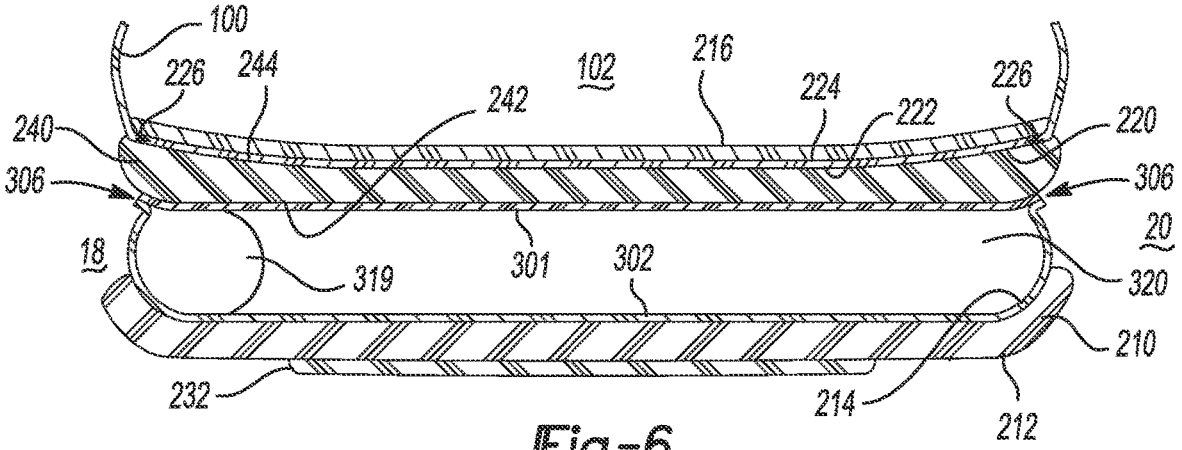
FIG. 6 is a cross-sectional view taken along line 6-6 of FIG. 5 showing a fluid-filled segment disposed within a forefoot region of the sole structure and extending continuously from a medial side of the sole structure to a lateral side of the sole structure.

FIG. 6 provides a cross-sectional view taken along line 6-6 of FIG. 5 showing the sole structure 200 in the forefoot region 12 with the stroble 220, the upper 100, the midsole 240, and the upper layer 301 of the fluid-filled chamber 300 arranged in the layered configuration as described above with reference to FIG. 3. The peripheral edges of the lower layer 302 extend upward toward the upper 100 and join with the peripheral edges of the upper layer 301 to form the flange 106 along the medial side 20 and the lateral side 18. The fluid-filled segment 320 extends continuously between the lateral side 18 and the medial side 20 and defines a tube-shaped cross section where the lower layer 302 and the upper layer 301 of the fluid-filled chamber 300 are separated to form the respective void for containing the pressurized fluid (e.g., air). Here, the tube-shaped cross-section provides a rounded contact surface with the ground surface for rolling engagement between the outsole 210 and the ground surface during use of the footwear 10 when performing forward movements such as running. Thus, the lower layer 301 and the upper layer 302 remain separated between the lateral side 18 and the medial side 20 to define the fluid-filled segment 320 that extends continuously between the lateral side 18 and the medial side 20 relative to the view of FIG. 6. FIG. 6 also shows the fluid-filled segment 319 that extends along the lateral side 18 and fluidly connects the fluid-filled segment 320 to the convergent fluid-filled segment 318.

The outsole 210 attaches to and conforms in shape with each of the fluid-filled segment 320. In some examples, the fluid-filled segment 320 defines a linear ridge extending along its length to support the outsole 210 for attaching thereto. In some examples, the contact pad 232 extends from the ground-engaging surface 212 of the outsole 210 in a direction away from the upper 100 and along the length of the fluid-filled segment 320 to provide increased traction with the ground surface. The contact surface 232 may further space the fluid-filled segment 320 from the ground surface to enhance the level of responsive-type cushioning when the fluid-filled segment 320 compresses to attenuate a ground-reaction force.

Figure 7:
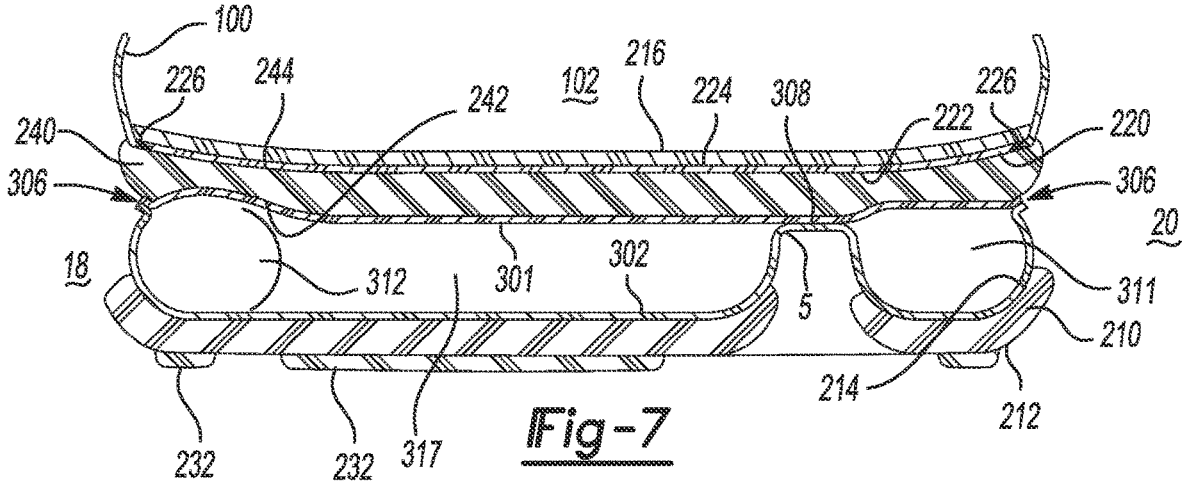
FIG. 7 is a cross-sectional view taken along line 7-7 of FIG. 5 showing fluid-filled segments disposed within a mid-foot region of the sole structure and separated from one another by a web area.

FIG. 7 provides a cross-sectional view taken along line 7-7 of FIG. 5 showing the sole structure 200 in the mid-foot region 14 with the stroble 220, the upper 100, the midsole 240, and the upper layer 301 of the fluid-filled chamber 300 arranged in the layered configuration as described above with reference to FIG. 3. The peripheral edges of the lower layer 302 may extend upward toward the upper 100 and join with the peripheral edges of the upper layer 301 to form the flange 106 along the medial side 20 and the lateral side 18. The lower layer 302 of the fluid-filled chamber 300 may also extend toward the upper 100 and join with the upper layer 301 to form a region of the web area 308 that extends between and separates the fluid-filled segments 317 and 311. For instance, the fluid-filled segment 311 extending along the medial side 20 of the sole structure 200 is bounded by the web area 308 and the flange 6 formed at the medial side 20, while the fluid-filled segment 317 extending from the fluid-filled segment 312 at the lateral side 18 toward the medial side 20 is bounded by the web area 308 and the flange 6 formed at the lateral side 18. The distal end 5 of the fluid-filled segment 317 tapers in the direction toward the upper 100 and terminates at the web area 308 formed at the location between the lateral side 18 and the medial side 20.

The outsole 210 attaches to and conforms in shape with each of the fluid-filled segments 311 and 317. In some examples, the fluid-filled segments 311 and 317 define a linear ridge extending along their lengths to support the outsole 210 for attaching thereto. In some examples, the contact pad 232 extends from the ground-engaging surface 212 of the outsole 210 in a direction away from the upper 100 and along respective lengths of the fluid-filled segments 311 and 317 to provide increased traction with the ground surface.

Figure 8:
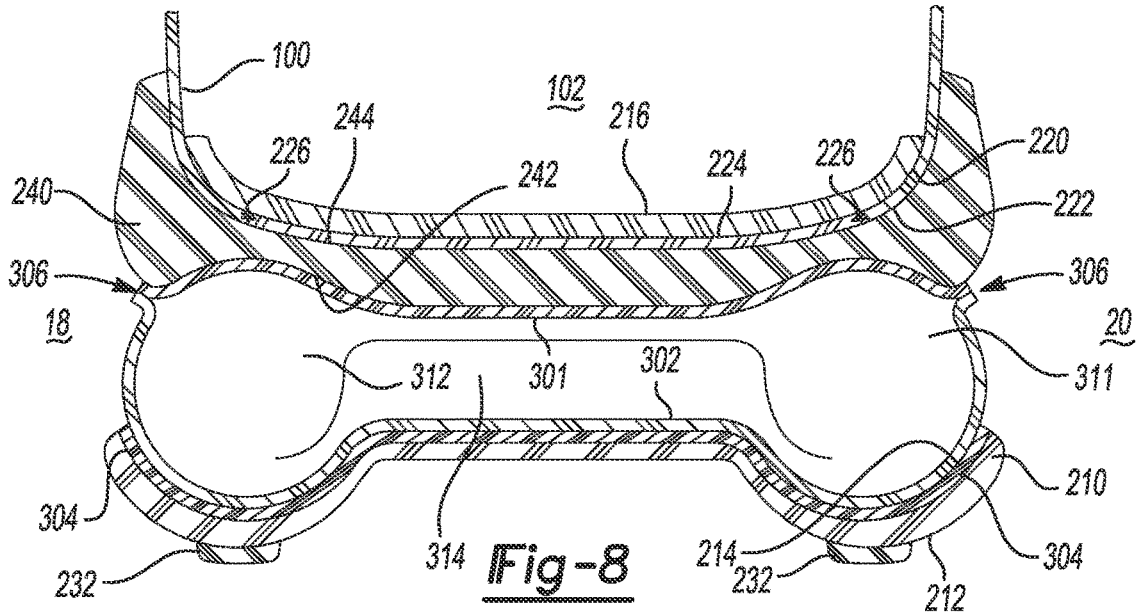
FIG. 8 is a cross-sectional view taken along line 8-8 of FIG. 5 showing a first fluid-filled segment extending along a lateral side of the sole structure fluidly connected to a second fluid-filled segment extending along a medial side of the sole structure.

FIG. 8 provides a cross-sectional view taken along line 8-8 of FIG. 5 showing the sole structure 200 in the mid-foot region 14 with the stroble 220, the upper 100, the midsole 240, and the upper layer 301 of the fluid-filled chamber 300 arranged in the layered configuration as described above with reference to FIG. 3. The peripheral edges of the lower layer 302 may extend upward toward the upper 100 and join with the peripheral edges of the upper layer 301 to form the flange 106 along the medial side 20 and the lateral side 18. Relative to the view of FIG. 8, the lower layer 302 protrudes away from the upper layer 301 in a direction away from the upper 100 to define the fluid-filled segments 312 and 311 that extend along respective ones of the lateral side 18 and the medial side 20 and the fluid-filled segment 314 extending between and fluidly coupled to the fluid-filled segments 312 and 311. More particularly, the lower layer 302 protrudes a further distance away from the upper layer 301 along the lateral side 18 and the medial side 20 to form the fluid-filled segments 312 and 311 with a greater thickness than the fluid-filled segment 314 extending therebetween.

As described above with reference to the footwear 10 of FIG. 4, the over mold portion 304 attaches to portions of the lower layer 302 in regions where the fluid-filled segments 311, 312, 314 protrude away from the upper 100 and toward the outsole 210 to provide increased durability and resiliency for the fluid-filled segments 311-316 in the heel region 16 and the mid-foot region 14. In some examples, the lower layer 302 of the fluid-filled chamber 300 is formed to include a reduced thickness along portions where the over mold portion 304 is attached thereto. The inner surface 214 of the outsole 210 attaches to the over mold portion 304. In some implementations, the fluid-filled segment 312 extending along the lateral side 18 and the fluid-filled segment 311 extending along the medial side 20 each include semi-tubular cross-sectional shapes relative to the view of FIG. 8 to facilitate inward and/or outward rolling of the sole structure 200 during lateral movements, while the fluid-filled segment 314 disposed between the lateral side 18 and the medial side 20 may include a reduced thickness to allow the fluid-filled segments 311 and 312 to absorb the initial impact of a ground-reaction force and thereby compress before the ground-reaction force is applied to the fluid-filled segment 314 in the center of sole structure 200 adjacent to the heel region 16, such that the trampoline effect is created as the fluid-filled segments 311, 312, 314 compress in succession, thereby providing gradient responsive-type cushioning as the outsole 210 rolls for engagement with the ground surface.

The outsole 210 attaches to and conforms in shape with each of the fluid-filled segments 311, 312, 314. In some examples, the fluid-filled segments 311, 312, 314 define a linear ridge extending along their lengths to support the outsole 210 for attaching thereto. In some examples, the contact pad 232 extends from the ground-engaging surface 212 of the outsole 210 in a direction away from the upper 100 and along respective lengths of the fluid-filled segments 311, 312, 314 to provide increased traction with the ground surface.

Figure 9:
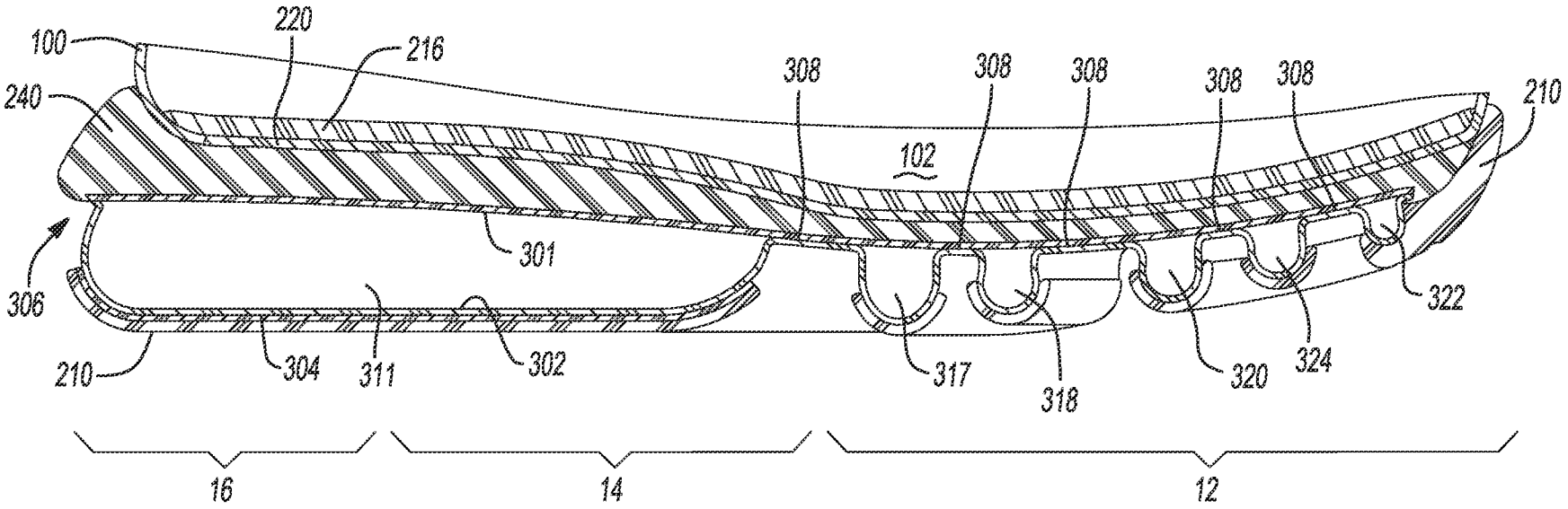
FIG. 9 is a cross-sectional view taken along line 9-9 of FIG. 5 showing fluid-filled segments extending through a forefoot region, a mid-foot region, and a heel region of the sole structure and between a lateral side of the sole structure and a medial side of the sole structure.

FIG. 9 provides a cross-sectional view taken along line 9-9 of FIG. 5 showing the sole structure 200 extending through the heel region 16, the mid-foot region 14, and the forefoot region 12. The sole structure 200 includes the stroble 220*a*, the midsole 240, and the upper layer 301 of the fluid-filled chamber 300 arranged in the layered configuration as described above with reference to FIG. 3. The fluid-filled segment 311 extends along the medial side 20 of the sole structure 200 within the heel region 16 and the mid-foot region 14. As described above with reference to the footwear 10 of FIGS. 4 and 8, the over mold portion 304 attaches to portions of the lower layer 302 in regions where the fluid-filled segment 311 protrudes away from the upper 100 and toward the outsole 210 to provide increased durability and resiliency for the fluid-filled segment 311 in the heel region 16 and the mid-foot region 14. Moreover, the fluid-filled segment 317 extends from lateral side 18 toward the medial side 20 to the distal end 5 that terminates at the location between the medial side 20 and the lateral side 18. The web area 308 may separate and extend between the fluid-filled segments 311 and 317 relative to the view of FIG. 9. In some examples, the fluid-filled segment 317 extends into the forefoot region 12 and is associated with a smaller thickness than segments in the heel region 16 and/or mid-foot region 14. In these examples, the over mold portion 304 is absent from the fluid-filled segment 317. In other configurations, the over mold portion 304 may attach to the fluid-filled segment 317.

FIG. 9 also shows the fluid-filled segment 318 that extends continuously between the lateral side 18 and the medial side 20, and in some implementations, extends substantially parallel with the fluid-filled segment 317. The fluid-filled segment 318 may also be convergent with the fluid-filled segment 320 extending continuously from the lateral side 18 to the medial side 20, whereby the segments 318 and 320 converge in the direction toward the medial side 20. As described above with reference to FIG. 5, the fluid-filled segments 318 and 320 are separated along the medial side 20 by the web area 306 and the flange 6. FIG. 9 also shows the fluid-filled segments 324 and 322 that extend between the lateral side 18 and the medial side 20 in directions substantially perpendicular to the longitudinal axis L of the sole structure 200. In some examples, the fluid-filled segment 324 is convergent with the fluid-filled segments 322 and 320. Additionally or alternatively, the fluid-filled segments 322 may be substantially parallel to the fluid-filled segment 320. FIG. 9 depicts the fluid-filled chamber 300 having a decreasing thickness as the sole structure 200 extends from the heel region 16 toward the forefoot region 12. For instance, the thickness of the fluid-filled segments 311, 317, 318, 320, 324, 322 gradually decreases in the direction extending toward the forefoot region 12 from the heel region 16.

Figure 10:
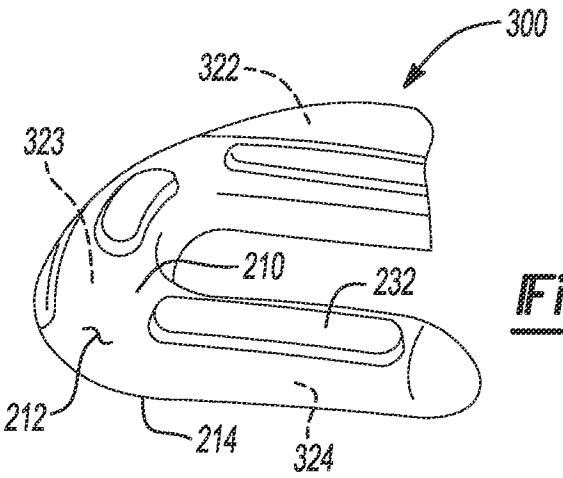
FIG. 10 is a perspective view of a fluid-filled segment having an outsole segment attached thereto.

FIG. 10 provides a bottom perspective view of the fluid-filled segments 322, 323, 324 fluidly connected to one another and disposed within the forefoot region 12 of the sole structure 200. In some examples, the fluid-filled segment 324 extends toward the medial side 20 to the distal end 5 that terminates at a location between the lateral side 18 and the medial side 20. The distal end 5 may taper in a direction toward the upper 100. The tapering by the distal end 5 of the fluid-filled segment 324 may function as an anchor point for the fluid-filled segment 324 when under an applied load. In some examples, the outsole 310 includes a shape that conforms to the shape and contour of the fluid-filled segments 322-324 (as well as segments 311-231) and attaches to the segments 322-324 via an adhesive or other attaching techniques. In some configurations, at least one of the fluid-filled segments 311-324 defines a linear ridge extending along its respective length that is configured to support the portion of the outsole 210 attached thereto. The outsole 210 includes the inner surface 214 opposing and attaching to a region of the lower surface 302 that protrudes away from the upper 100 and the ground-engaging surface 212 disposed on an opposite side of the outsole 210 than the inner surface 214. In some examples, a contact pad 232 protrudes away from the ground-engaging surface 212 and extends along the length of each respective fluid-filled segment 322-324. The outsole 212 and other contact pads 232 may attach to the fluid-filled segments 311-321 in a similar fashion.

Figure 11:
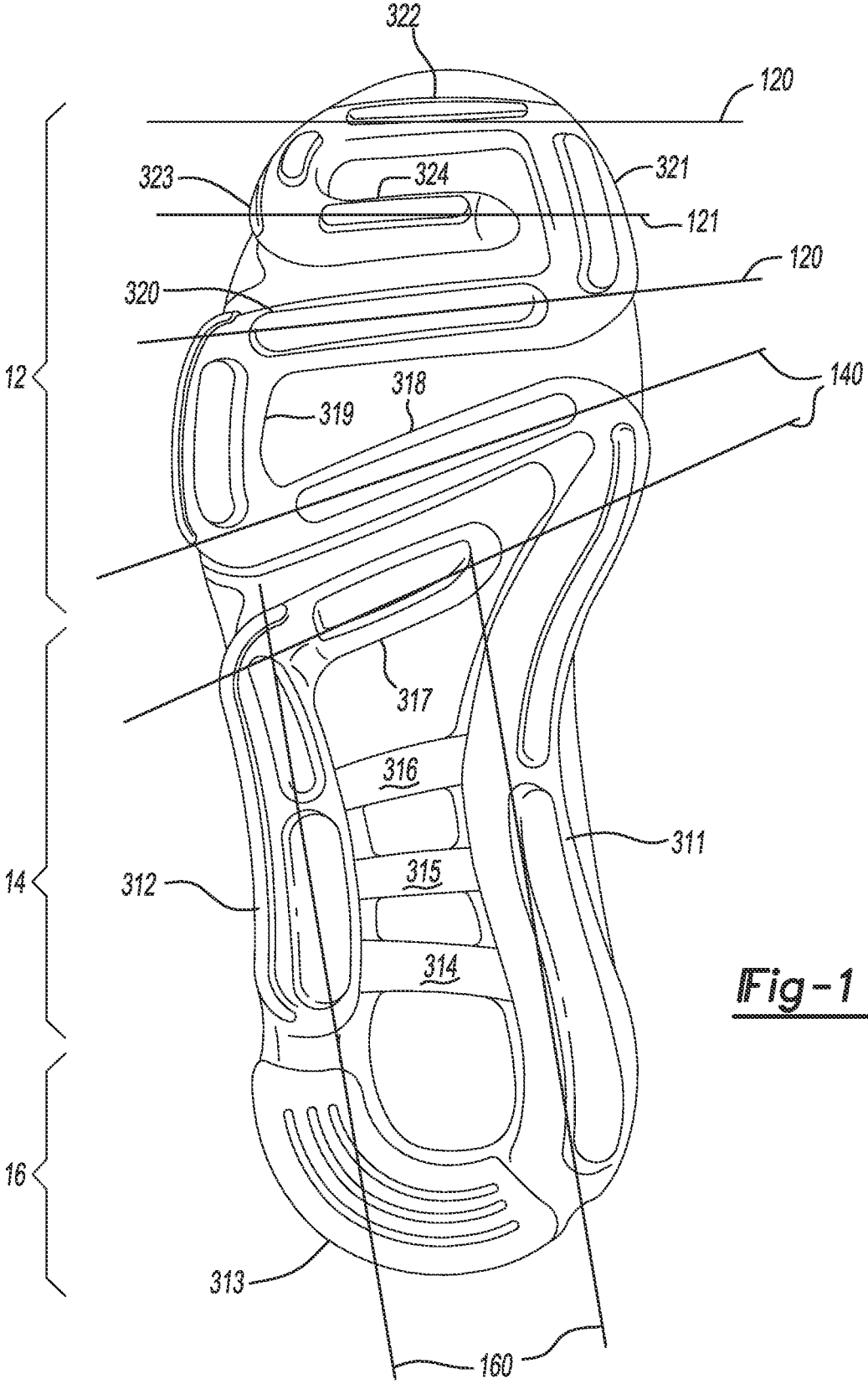
FIG. 11 is a bottom perspective view of the article of footwear of FIG. 1 showing cushioning and vectors defined by a fluid-filled chamber of a sole structure.

FIG. 11 provides a bottom perspective view of the article of footwear 10 of FIG. 1 showing a plurality of cushioning support vectors 120, 121, 140, 160 defined by the fluid-filled segments 311-324. More particularly, a longitudinal axis of each of the fluid-filled segments 311 and 312 extending between the heel region 16 and the mid-foot region 14 define respective ones of the cushioning support vectors 160 and a longitudinal axis of each of the fluid-filled segments 317, 318, 320, 322, 324 extending between the lateral side 18 and the medial side 20 of the sole structure 200 defines a respective one of the cushioning support vectors 120, 121, 140. Applied loads associated with directions parallel to a cushioning support vector cause the one or more corresponding fluid-filled segments to substantially retain their shape without collapsing to provide support and stability for the foot in those regions. On the other hand, applied loads associated with directions transverse to a cushioning support vector cause the one or more corresponding fluid-filled segments to compress and collapse to provide cushioning for the foot in those regions by attenuating the ground-reaction force associated with the applied load. The cushioning support vectors 160 may extend substantially parallel to the longitudinal axis L of the sole structure 200 while the cushioning support vectors 120, 121, 140 extend transversely to the longitudinal axis L of the sole structure 200. For instance, the cushioning support vectors 120, 121, 140 may define angles within 15 degrees (15°) from perpendicular relative to the longitudinal axis L of the sole structure 200.

In some implementations, a first series of cushioning support vectors 160 are disposed within the heel region 16 and the mid-foot region 14 and extend substantially parallel to one another in a direction substantially parallel to the longitudinal axis L of the sole structure 200. During forward movements, such as walking or running movements, loads applied to the sole structure 200 are associated with a direction parallel to the first series of vectors 160 to cause the respective fluid-filled segments 311 and 312 to be under shear force, thereby causing the respective fluid-filled segments 311 and 312 to retain their shape (e.g., not compress) and provide support and stability as the outsole rolls for engagement with the ground surface through the heel region 16 and the mid-foot region 14. The fluid-filled segments 314, 315, 316 extending between and fluidly coupling the fluid-filled segments 311 and 312 reduce torsional forces from acting upon the fluid-filled segments 311 and 312 when under applied load to thereby dampen oscillations by the foot while providing gradient responsive-type cushioning.

During lateral movements, such as shifting or cutting movements, loads applied to the sole structure 200 are associated with a direction transverse and generally perpendicular to the first series of vectors 160. Thus, the fluid-filled segment 311 defining one of the vectors 160 will compress to provide cushioning for the medial side of the foot when the applied load is in a direction toward the medial side 20 of the sole structure 200, while the fluid-filled segment 312 defining the other vector 160 will compress to provide cushioning for the lateral side of the foot when the applied load is in a direction toward the lateral side 18 of the sole structure 200.

In some implementations, a second series of cushioning support vectors 140 are disposed within the mid-foot 14 and forefoot region 12 and extend substantially parallel to one another in a direction substantially perpendicular to the longitudinal axis L of the sole structure 200. Moreover, a third series of cushioning support vectors 120 are disposed within the forefoot region 12 and extend parallel to one another in a direction transverse to the longitudinal axis L of the sole structure 200 and converging with the second series of support vectors 140 in the direction toward the medial side 20. A fourth vector 121 is also disposed within the forefoot region 12 between the third series of vectors 120 and extends in a direction transverse to the longitudinal axis L of the sole structure 200 and converging with the second and third series of support vectors 140 and 120.

During forward movements, such as walking or running movements, loads applied to the sole structure 200 are associated with a direction transverse to the first, second, and third series of vectors 140, 120, 121. Thus, the respective fluid-filled segments 317, 318, 320, 322, 324 defining respective ones of the vectors 140, 120, 121 successively compress and collapse to provide cushioning for the metatarsal region of the foot through push off from the ground-surface. The direction of the vectors 140, 120, 121 relative to the direction of the applied load as well as a length of the respective segments 317, 318, 320, 322, 324 dictates how the segments will compress for attenuating the ground-reaction force.

With reference to FIGS. 5 and 11, the arrangement of the fluid-filled segments 320 and 318 being separated by the web area 308 along the medial side 20 and converging toward one another in the direction toward the medial side 20 is operative to dampen foot oscillations caused by applied loads during forward movements (e.g., running movements) as the segments 320 and 318 compress to provide cushioning for the metatarsal region of the foot by attenuating ground-reaction forces. Moreover, the fluid-filled segment 324 having the distal end 5 terminating at the location between the lateral side 18 and the medial side 20 is separated from the fluid-filled segment 321 at the medial side 20 by the web area 308 and is also separated from the fluid-filled segment 320 at the lateral side 18 by the web area 308. This arrangement of the fluid-filled segments 324 and 320 being separated by the web area 308 along the lateral side 18 and converging toward one another is also operative to dampen the foot oscillations as the segments 320 and 324 compress to provide cushioning for the metatarsal-phalangeal joints of the foot prior to toe off.

During lateral movements, such as shifting or cutting movements, loads applied to the sole structure 200 are associated with a direction generally parallel or only slightly transverse to the vectors 140, 120, 141 to cause the respective fluid-filled segments 317, 318, 320, 324, 322 to be under shear force, thereby causing the respective segments 317, 318, 320, 324, 322 to retain the their shape (e.g., not compress or slightly compress) and provide support and stability for the metatarsal region of the foot responsive to the footwear 10 performing a lateral movement. With reference to FIG. 5, the distal ends 5 of the fluid-filled segments 317 and 314 may each taper in the direction toward the upper 100 and serve as anchor points for the fluid-filled chamber 300 as a whole to provide fluid-communication between the fluid-filled segment 317 and the fluid-filled segment 324 during use of the footwear 10, and more particularly, during use of the footwear 10 during forward running movements.

The following Clauses provide an exemplary configuration for an article of footwear described above.

Clause 1: A sole structure for an article of footwear having an upper, the sole structure comprising a heel region, a forefoot region, and a midfoot region disposed between the heel region and the forefoot region. A fluid-filled chamber including a first barrier layer cooperating with a second barrier layer to define a first fluid-filled segment extending along a medial side of the sole structure within the heel region, a second fluid-filled segment extending along a lateral side of the sole structure within the heel region, and a web area disposed between and connecting the first fluid-filled segment and the second fluid-filled segment, the first barrier layer being attached to the second barrier layer within the web area.

Clause 2: The sole structure of Clause 1, wherein the first fluid-filled segment and the second fluid-filled segment include a ground-contacting surface.

Clause 3: The sole structure of Clause 2, wherein the web area is recessed from the ground-contacting surface.

Clause 4: The sole structure of any of the preceding Clauses, wherein the first fluid-filled segment is fluidly coupled to the second fluid-filled segment.

Clause 5: The sole structure of any of the preceding Clauses, wherein the fluid-filled chamber includes a third fluid-filled segment extending around the heel region and fluidly coupled to the first fluid-filled segment and the second fluid-filled segment.

Clause 6: The sole structure of any of the preceding Clauses, wherein the fluid-filled chamber includes a fourth fluid-filled segment extending between and connected to the first fluid-filled segment and the second fluid-filled segment, the fourth fluid-filled segment extending between the medial side and the lateral side.

Clause 7: The sole structure of Clause 6, wherein the web area is bounded by the first fluid-filled segment, the second fluid-filled segment, the third fluid-filled segment, and the fourth fluid-filled segment.

Clause 8: The sole structure of any of the preceding Clauses, wherein the web area is disposed proximate to the upper.

Clause 9: The sole structure of any of the preceding Clauses, wherein the fluid-filled chamber includes a fifth fluid-filled segment extending from the first fluid-filled segment toward the lateral side of the sole structure.

Clause 10: The sole structure of any of the preceding Clauses, wherein the fluid-filled chamber includes a sixth fluid-filled segment extending from the second fluid-filled segment toward the medial side of the sole structure.

Clause 11: The sole structure of Clause 10, wherein the fifth fluid-filled segment is substantially parallel to the sixth fluid-filled segment.

Clause 12: The sole structure of any of Clauses 9-11, wherein the sixth fluid-filled segment includes a distal end that terminates at a location between the medial side and the lateral side.

Clause 13: The sole structure of any of Clauses 9-12, wherein the distal end tapers in a direction toward the upper.

Clause 14: The sole structure of any of Clauses 9-13, wherein the fifth fluid-filled segment extends continuously from the medial side to the lateral side.

Clause 15: The sole structure of any of Clauses 9-14, wherein the fifth fluid-filled segment includes a distal end that terminates at a location between the medial side and the lateral side within the forefoot region.

Clause 16: The sole structure of Clause 15, wherein the distal end of the fifth fluid-filled segment tapers in a direction toward the upper.

Clause 17: The sole structure of any of the preceding Clauses, further comprising an over mold portion extending over a portion of the fluid-filled chamber.

Clause 18: The sole structure of Clause 17, wherein the over mold portion extends over the heel region.

Clause 19: The sole structure of Clause 18, wherein the over mold portion extends over the midfoot region.

Clause 20: The sole structure of Clause 19, wherein the over mold portion extends into the forefoot region.

Clause 21: The sole structure of any of Clauses 17-20, wherein the over mold portion is bonded to the second barrier layer and includes at least one of a different thickness, a different hardness, and a different material than the second barrier layer.

Clause 22: An article of footwear incorporating the sole structure of any of the preceding Clauses.

Clause 23: A sole structure for an article of footwear having an upper, the sole structure comprising a heel region, a forefoot region, and a midfoot region disposed between the heel region and the forefoot region. A fluid-filled chamber including a first barrier layer cooperating with a second barrier layer to define a first fluid-filled segment extending continuously between a medial side of the sole structure and a lateral side of the sole structure within the forefoot region, a second fluid-filled segment extending continuously between the medial side of the sole structure and the lateral side of the sole structure within the forefoot region, and a web area disposed between and connecting the first fluid-filled segment and the second fluid-filled segment, the first barrier layer being attached to the second barrier layer within the web area.

Clause 24: The sole structure of Clause 23, wherein the first fluid-filled segment and the second fluid-filled segment include a ground-contacting surface.

Clause 25: The sole structure of Clause 24, wherein the web area is recessed from the ground-contacting surface.

Clause 26: The sole structure of any of the preceding Clauses, wherein the first fluid-filled segment is fluidly coupled to the second fluid-filled segment.

Clause 27: The sole structure of any of the preceding Clauses, wherein the fluid-filled chamber includes a third fluid-filled segment extending along one of the medial side and the lateral side and fluidly coupled to the first fluid-filled segment and the second fluid-filled segment.

Clause 28: The sole structure of any of the preceding Clauses, wherein the first fluid-filled segment and the second fluid-filled segment converge toward one another in a direction extending from the one of the medial side and the lateral side to the other of the medial side and the lateral side.

Clause 29: The sole structure of any of the preceding Clauses, wherein the web area extends between the first fluid-filled segment and the second fluid-filled segment at the other of the medial side and the lateral side.

Clause 30: The sole structure of any of the preceding Clauses, wherein the first fluid-filled segment is spaced apart from the second fluid-filled segment at the other of the medial side and the lateral side.

Clause 31: The sole structure of any of the preceding Clauses, wherein the web area extends continuously from the third fluid-filled segment to the other of the medial side and the lateral side.

Clause 32: The sole structure of any of Clauses 27-31, wherein the web area is bounded by the first fluid-filled segment, the second fluid-filled segment, the third fluid-filled segment, and the other of the medial side and the lateral side Clause 33: The sole structure of any of the preceding Clauses, wherein the web area is disposed proximate to the upper.

Clause 34: The sole structure of any of the preceding Clauses, wherein the fluid-filled chamber includes a fourth fluid-filled segment extending from the second fluid-filled segment along the other of the medial side and the lateral side.

Clause 35: The sole structure of any of the preceding Clauses, wherein the fluid-filled chamber includes a fifth fluid-filled segment fluidly coupled to the fourth fluid-filled segment and extending from the one of the medial side and the lateral side toward the other of the medial side and the lateral side.

Clause 36: The sole structure of Clause 35, wherein the fourth fluid-filled segment is substantially parallel to the fifth fluid-filled segment.

Clause 37: The sole structure of any of Clause 35-36, wherein the fifth fluid-filled segment includes a distal end that terminates at a location between the medial side and the lateral side.

Clause 38: The sole structure of any of Clauses 35-37, wherein the distal end tapers in a direction toward the upper.

Clause 39: The sole structure of any of the preceding Clauses, further comprising an over mold portion extending over a portion of the fluid-filled chamber.

Clause 40: The sole structure of Clause 39, wherein the over mold portion extends over the heel region.

Clause 41: The sole structure of Clause 40, wherein the over mold portion extends over the midfoot region.

Clause 42: The sole structure of Clause 41, wherein the over mold portion extends into the forefoot region.

Clause 43: The sole structure of any of Clauses 39-42, wherein the over mold portion is bonded to the second barrier layer and includes at least one of a different thickness, a different hardness, and a different material than the second barrier layer.

Clause 44: An article of footwear incorporating the sole structure of any of the preceding Clauses.

Clause 45: A sole structure for an article of footwear having an upper, the sole structure comprising a heel region, a forefoot region, and a midfoot region disposed between the heel region and the forefoot region. A fluid-filled chamber including a first barrier layer cooperating with a second barrier layer to define a first fluid-filled segment extending along one of a medial side of the sole structure and a lateral side of the sole structure from the heel region to the forefoot region, a second fluid-filled segment extending from the one of the medial side and the lateral side to the other of the medial side and the lateral side, and a third fluid-filled segment extending from the other of the medial side and the lateral side to the one of the medial side and the lateral side.

Clause 46: The sole structure of Clause 45, wherein the first fluid-filled segment and the second fluid-filled segment include a ground-contacting surface.

Clause 47: The sole structure of Clause 46, wherein the ground-contacting surface extends uninterrupted from the heel region to the forefoot region along the first fluid-filled segment, the second fluid-filled segment, and the third fluid-filled segment.

Clause 48: The sole structure of any of the preceding Clauses, wherein the second fluid-filled segment extends continuously from the one of the medial side and the lateral side to the other of the medial side and the lateral side.

Clause 49: The sole structure of any of the preceding Clauses, wherein the third fluid-filled segment extends continuously from the other of the medial side and the lateral side to the one of the medial side and the lateral side.

Clause 50: The sole structure of any of the preceding Clauses, wherein the fluid-filled chamber includes a fourth fluid-filled segment extending along the other of the medial side and the lateral side.

Clause 51: The sole structure of Clause 50, wherein the fourth fluid-filled segment extends between and fluidly couples the second fluid-filled segment and the third fluid-filled segment.

Clause 52: The sole structure of any of the preceding Clauses, wherein the web area is recessed from a ground-contacting surface of the fluid-filled chamber.

Clause 53: The sole structure of any of the preceding Clauses, wherein the second fluid-filled segment and the third fluid-filled segment converge toward one another in a direction extending from the other of the medial side and the lateral side to the one of the medial side and the lateral side.

Clause 54: The sole structure of any of the preceding Clauses, wherein the web area extends between the second fluid-filled segment and the third fluid-filled segment at the one of the medial side and the lateral side.

Clause 55: The sole structure of any of the preceding Clauses, wherein the second fluid-filled segment is spaced apart from the third fluid-filled segment at the one of the medial side and the lateral side.

Clause 56: The sole structure of any of the preceding Clauses, wherein the web area extends continuously from the fourth fluid-filled segment to the other of the medial side and the lateral side.

Clause 57: The sole structure of any of the preceding Clauses, wherein the web area is bounded by the second fluid-filled segment, the third fluid-filled segment, the fourth fluid-filled segment, and the one of the medial side and the lateral side Clause 58: The sole structure of any of the preceding Clauses, wherein the web area is disposed proximate to the upper.

Clause 59: The sole structure of any of the preceding Clauses, wherein the fluid-filled chamber includes a fifth fluid-filled segment extending from the third fluid-filled segment along the one of the medial side and the lateral side.

Clause 60: The sole structure of any of the preceding Clauses, wherein the fluid-filled chamber includes a sixth fluid-filled segment fluidly coupled to the fifth fluid-filled segment and extending from the other of the medial side and the lateral side toward the one of the medial side and the lateral side.

Clause 61: The sole structure of Clause 60, wherein the fifth fluid-filled segment is substantially parallel to the sixth fluid-filled segment.

Clause 62: The sole structure of any of Clauses 60-61, wherein the sixth fluid-filled segment includes a distal end that terminates at a location between the medial side and the lateral side.

Clause 63: The sole structure of any of Clauses 60-62, wherein the distal end tapers in a direction toward the upper.

Clause 64: The sole structure of any of the preceding Clauses, further comprising an over mold portion extending over a portion of the fluid-filled chamber.

Clause 65: The sole structure of Clause 64, wherein the over mold portion extends over the heel region.

Clause 66: The sole structure of Clause 65, wherein the over mold portion extends over the midfoot region.

Clause 67: The sole structure of Clause 66, wherein the over mold portion extends into the forefoot region.

Clause 68: The sole structure of any of Clauses 64-67, wherein the over mold portion is bonded to the second barrier layer and includes at least one of a different thickness, a different hardness, and a different material than the second barrier layer.

Clause 69: An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a heel region;

a forefoot region;

a midfoot region disposed between the heel region and the forefoot region; and a fluid-filled chamber including a first barrier layer cooperating with a second barrier layer to define (i) a first fluid-filled segment extending continuously from a medial edge of the sole structure to a lateral edge of the sole structure, (ii) a second fluid-filled segment extending from the first fluid-filled segment along one of the medial edge and the lateral edge, (iii) a third fluid-filled segment extending from the second fluid-filled segment from the one of the medial edge and the lateral edge to the other of the medial edge and the lateral-side edge, (iv) a fourth fluid-filled segment extending between the first fluid-filled segment and the third fluid-filled segment and terminating at a distal end between the medial edge and the lateral edge, the distal end opposing the second fluid-filled segment, and (v) a fifth fluid-filled segment extending along the other of the medial edge and the lateral edge, the fourth fluid-filled segment directly fluidly connected to and extending from the fifth fluid-filled segment, each of the first fluid-filled segment, the second fluid-filled segment, the third fluid-filled segment, the fourth fluid-filled segment, and the fifth fluid-filled segment defining a substantially tubular cross-sectional shape.

2. The sole structure of claim 1, wherein the fourth fluid-filled segment is substantially parallel to the first fluid-filled segment.

3. The sole structure of claim 2, wherein the fourth fluid-filled segment is substantially parallel to the third fluid-filled segment.

4. The sole structure of claim 1, wherein the fourth fluid-filled segment is substantially parallel to the third fluid-filled segment.

5. The sole structure of claim 1, wherein the distal end tapers in a direction away from a ground-engaging surface of the sole structure.

6. The sole structure of claim 1, wherein the distal end is spaced apart and separated from the second fluid-filled segment.

7. The sole structure of claim 1, wherein the fifth fluid-filled segment extends between and fluidly couples the third fluid-filled segment and the fourth fluid-filled segment.

8. The sole structure of claim 7, wherein the fifth fluid-filled segment is arcuate.

9. An article of footwear incorporating the sole structure of claim 1.

10. A sole structure for an article of footwear, the sole structure comprising:

a heel region;

a forefoot region;

a midfoot region disposed between the heel region and the forefoot region; and a fluid-filled chamber including a first barrier layer cooperating with a second barrier layer to define (i) a first fluid-filled segment extending along one of a medial edge of the sole structure and a lateral edge of the sole structure, (ii) a second fluid-filled segment extending continuously from the first fluid-filled segment from the one of the medial edge and the lateral edge to the other of the medial edge and the lateral-side edge, (iii) a third fluid-filled segment extending adjacent to the second fluid-filled segment, (iv) a fourth fluid-filled segment extending along the other of the medial edge and the lateral edge, and between and fluidly coupling the second fluid-filled segment and the third fluid-filled segment, the fourth fluid-filled segment having an arcuate shape, the third fluid-filled segment directly fluidly connected to and extending from the fourth fluid-filled segment, each of the first fluid-filled segment, the second fluid-filled segment, the third fluid-filled segment, and the fourth fluid-filled segment defining a substantially tubular cross-sectional shape.

11. The sole structure of claim 10, wherein the second fluid-filled segment is substantially parallel to the third fluid-filled segment.

12. The sole structure of claim 10, wherein the distal end opposes the first fluid-filled segment.

13. The sole structure of claim 10, wherein the distal end is spaced apart and separated from the first fluid-filled segment.

14. The sole structure of claim 10, wherein the distal end tapers in a direction away from a ground-engaging surface of the sole structure.

15. The sole structure of claim 10, further comprising a fifth fluid-filled segment extending from the one of the medial edge and the lateral edge in a direction toward the other of the medial edge and the lateral edge.

16. The sole structure of claim 15, wherein the fifth fluid-filled segment extends from and is fluidly coupled to the first fluid-filled segment at an opposite end of the first fluid-filled segment than the second fluid-filled segment.

17. The sole structure of claim 15, wherein the fifth fluid-filled segment is substantially parallel to the third fluid-filled segment.

18. An article of footwear incorporating the sole structure of claim 10.

* * * * *